US011808143B2

(12) United States Patent
Auchere et al.

(10) Patent No.: US 11,808,143 B2
(45) Date of Patent: Nov. 7, 2023

(54) METHODS AND APPARATUS TO MEASURE FORMATION FEATURES

(71) Applicant: Schlumberger Technology Corporation, Sugar Land, TX (US)

(72) Inventors: Jean-Christophe Auchere, Gif-sur-Yvette (FR); Hiroshi Hori, Châtillon (FR); Adam Pedrycz, Edmonton (CA); Bharat Narasimhan, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/660,845

(22) Filed: Apr. 27, 2022

(65) Prior Publication Data

US 2022/0251946 A1 Aug. 11, 2022

Related U.S. Application Data

(63) Continuation of application No. 16/412,140, filed on May 14, 2019, now Pat. No. 11,346,213.
(Continued)

(51) Int. Cl.
*E21B 47/12* (2012.01)
*E21B 44/02* (2006.01)
*E21B 49/00* (2006.01)

(52) U.S. Cl.
CPC ..... *E21B 47/12* (2013.01); *E21B 44/02* (2013.01); *E21B 49/00* (2013.01)

(58) Field of Classification Search
CPC ..... E21B 47/12; E21B 44/02; E21B 49/00; E21B 47/04
See application file for complete search history.

(56) References Cited

U.S. PATENT DOCUMENTS 2,769,867 A 11/1956 Crownover
3,437,834 A 4/1969 Schwartz
(Continued)

FOREIGN PATENT DOCUMENTS

CA 2581535 A1 4/2006
CN 202788824 3/2013
(Continued)

OTHER PUBLICATIONS

B. Mandal and A. Quintero, "A new monocable circumferential acoustic scanner tool (Cast-M) for cased-hole and openhole applications", SPWLA 51st Annual Logging Symposium held in Perth, Western Australia, Jun. 19-23, 2010 (Year: 2010).*
(Continued)

*Primary Examiner* — Douglas Kay
(74) *Attorney, Agent, or Firm* — Jeffrey D. Frantz

(57) ABSTRACT

Methods, apparatus, systems, and articles of manufacture are disclosed to measure a formation feature. An example apparatus includes a pre-processor to compare a first measurement obtained from a first sensor included in a logging tool at a first depth at a first time and a second measurement obtained from a second sensor included in the logging tool at the first depth at a second time. The example apparatus also include a semblance calculator to: calculate a correction factor based on a difference between the first measurement and the second measurement; and calculate a third measurement based on the correction factor and a fourth measurement obtained from the first sensor at a second depth at the second time. The example apparatus also includes a report generator to generate a report including the third measurement.

20 Claims, 14 Drawing Sheets

Related U.S. Application Data

(60) Provisional application No. 62/670,896, filed on May 14, 2018, provisional application No. 62/670,887, filed on May 14, 2018.

(56) References Cited

U.S. PATENT DOCUMENTS

| | | | | |
|---|---|---|---|---|
| 3,502,169 | A | 3/1970 | Chapman | |
| 3,524,162 | A | 8/1970 | Zill | |
| 4,255,798 | A | 3/1981 | Havira | |
| 4,594,691 | A | 6/1986 | Kimball et al. | |
| 4,594,692 | A | 6/1986 | Read et al. | |
| 4,757,479 | A | 7/1988 | Masson et al. | |
| 5,299,578 | A | 4/1994 | Rotteveel et al. | |
| 5,354,956 | A | 10/1994 | Orban et al. | |
| 5,398,215 | A | 3/1995 | Sinha et al. | |
| 5,511,037 | A * | 4/1996 | Randall | G01V 1/32 324/369 |
| 5,581,024 | A * | 12/1996 | Meyer, Jr. | G01V 11/00 702/6 |
| 5,747,672 | A | 5/1998 | Parent et al. | |
| 5,753,812 | A | 5/1998 | Aron et al. | |
| 6,205,087 | B1 | 3/2001 | Fukuhara et al. | |
| 6,466,513 | B1 | 10/2002 | Pabon et al. | |
| 6,483,225 | B1 | 11/2002 | Spigelmyer | |
| 6,510,389 | B1 | 1/2003 | Winkler et al. | |
| 6,643,221 | B1 | 11/2003 | Hsu et al. | |
| 6,678,616 | B1 | 1/2004 | Winkler et al. | |
| 7,399,284 | B2 | 7/2008 | Miwa et al. | |
| 7,460,435 | B2 | 12/2008 | Garcia-Osuna et al. | |
| 7,675,813 | B2 | 3/2010 | Valero et al. | |
| 7,694,570 | B1 | 4/2010 | Dam et al. | |
| 7,913,806 | B2 | 3/2011 | Pabon et al. | |
| 9,027,670 | B2 | 5/2015 | Sugiura | |
| 9,625,599 | B2 | 4/2017 | Prioul et al. | |
| 10,012,763 | B2 | 7/2018 | Perkins et al. | |
| 10,605,944 | B2 | 3/2020 | Han et al. | |
| 11,346,213 | B2 * | 5/2022 | Auchere | E21B 44/02 |
| 2003/0067249 | A1 | 4/2003 | Lockwood et al. | |
| 2003/0073906 | A1 | 4/2003 | Flesch et al. | |
| 2003/0130657 | A1 | 7/2003 | Tom et al. | |
| 2003/0144989 | A1 | 7/2003 | Schoemann | |
| 2004/0048470 | A1 | 3/2004 | Dinet et al. | |
| 2005/0152219 | A1 | 7/2005 | Garcia-Osuna et al. | |
| 2006/0133205 | A1 | 6/2006 | Van Kuijk et al. | |
| 2006/0233048 | A1 | 10/2006 | Froelich et al. | |
| 2006/0254767 | A1 | 11/2006 | Pabon et al. | |
| 2007/0124000 | A1 | 5/2007 | Moughler et al. | |
| 2008/0037808 | A1 | 2/2008 | Sawada et al. | |
| 2008/0186805 | A1 | 8/2008 | Han | |
| 2008/0228231 | A1 | 9/2008 | Raphael et al. | |
| 2009/0183941 | A1 | 7/2009 | Pabon et al. | |
| 2012/0029393 | A1 | 2/2012 | Lee | |
| 2013/0060140 | A1 | 3/2013 | Sinelnikov | |
| 2013/0286778 | A1 | 10/2013 | Kisner et al. | |
| 2013/0341091 | A1 * | 12/2013 | Sugiura | E21B 45/00 175/24 |
| 2014/0013850 | A1 | 1/2014 | Kim et al. | |
| 2014/0031164 | A1 | 1/2014 | Fukuoka et al. | |
| 2015/0211352 | A1 | 7/2015 | Sugiura | |
| 2017/0167253 | A1 | 6/2017 | Lemarenko et al. | |
| 2017/0199295 | A1 | 7/2017 | Mandal | |
| 2017/0293044 | A1 | 10/2017 | Gilstrap et al. | |
| 2017/0314385 | A1 | 11/2017 | Hori et al. | |
| 2018/0017701 | A1 * | 1/2018 | San Martin | E21B 44/00 |
| 2019/0310173 | A1 | 10/2019 | Mayes | |
| 2019/0345816 | A1 * | 11/2019 | Auchere | E21B 44/02 |
| 2020/0363550 | A1 | 11/2020 | Nakajima et al. | |
| 2021/0055444 | A1 | 2/2021 | Hori et al. | |

FOREIGN PATENT DOCUMENTS

| | | | |
|---|---|---|---|
| CN | 104520734 | A | 4/2015 |
| CN | 104594878 | A | 5/2015 |
| CN | 107530735 | A | 1/2018 |
| EP | 1806473 | A1 | 7/2007 |
| EP | 2685255 | | 1/2014 |
| JP | 3372572 | B2 | 2/2003 |
| KR | 200442120 | Y1 | 10/2008 |
| KR | 101547508 | B1 | 8/2015 |
| WO | 2009061561 | A1 | 5/2009 |
| WO | 2012027630 | A2 | 3/2012 |
| WO | 2013081608 | A1 | 6/2013 |

OTHER PUBLICATIONS

D. Dashevskiy and et al, "Dynamic Depth Correction To Reduce Depth Uncertainty and Improve MWD/LWD Log Quality", Mar. 2008 SPE Drilling & Completion (Year: 2008).*

Kimball, C. V. et al., Semblance Processing of Borehole Acoustic Array Data, Geophysics, 1984, 49(3), pp. 274-281.

International Search Report and Written Opinion issued in International Patent application PCT/US2019/017146 dated May 7, 2019, 13 pages.

International Search Report and Written Opinion issued in International Patent application PCT/US2019/017145 on May 21, 2019, 11 pages.

Dashevskiy, D. et al., "Dynamic Depth Correction to Reduce Depth Uncertainty and Improve MWD/LWD Log Quality", Mar. 2008 SPE Drilling Completion, pp. 13-22.

Office Action issued in U.S. Appl. No. 16/967,147 dated Dec. 24, 2021, 24 pages.

Mandal et al., "A new monocable circumferential acoustic scanner tool (Cast-M) for cased-hole and openhole applications", SPWLA 51st Annual Logging Symposium held in Perth, Western Australia, Jun. 19-23, 2010, 14 pages.

Office Action issued in U.S. Appl. No. 16/967,149 dated May 9, 2023, 11 pages.

Zhang, X. et al., "Application of Modern Acoustic Logging Technology", Petroleum (Logging) Instruments, 2014, 28 (1), pp. 1-6.

First Office Action issued in China Patent Application No. 2019800143364 dated Feb. 21, 2023, 28 pages with English translation.

First Office Action issued in China Patent Application No. 201980013713.2 dated Feb. 21, 2023, 39 pages with English translation.

* cited by examiner

Unit Data at Number of Turn, k
(Scan Lines from k-m to k+m, m=0,1,2,3...)

METHODS AND APPARATUS TO MEASURE FORMATION FEATURES

RELATED APPLICATIONS

This application is a Continuation of U.S. patent application Ser. No. 16/412,140, entitled "Methods and Apparatus to Measure Formation Features", filed May 14, 2019, which claims priority to U.S. Provisional Patent Application Ser. No. 62/670,887, filed on May 14, 2018 and U.S. Provisional Patent Application Ser. No. 62/670,896, filed on May 14, 2018. U.S. Provisional Patent Application Ser. No. 62/670,887 and U.S. Provisional Patent Application Ser. No. 62/670,896 are Incorporated by Reference herein in their entireties.

FIELD OF THE DISCLOSURE

This disclosure relates generally to borehole logging tools and, more particularly, to methods and apparatus to measure formation features.

BACKGROUND

The oil and gas industry uses various tools to probe a formation penetrated by a borehole to determine types and quantities of hydrocarbons in a hydrocarbon reservoir. Among these tools, logging while drilling (LWD) tools and measurement while drilling (MWD) tools have been used to provide valuable information regarding formation properties. Typically, in oilfield logging, a logging tool is lowered into a borehole and energy in the form of acoustic waves, electromagnetic waves, etc., is transmitted from a source into the borehole and surrounding formation. The energy that travels through the borehole and formation is detected with one or more sensors or receivers to characterize the formation.

BRIEF DESCRIPTION OF THE DRAWINGS

The figures are not to scale. In general, the same reference numbers will be used throughout the drawing(s) and accompanying written description to refer to the same or like parts.

DETAILED DESCRIPTION

Figure 1:
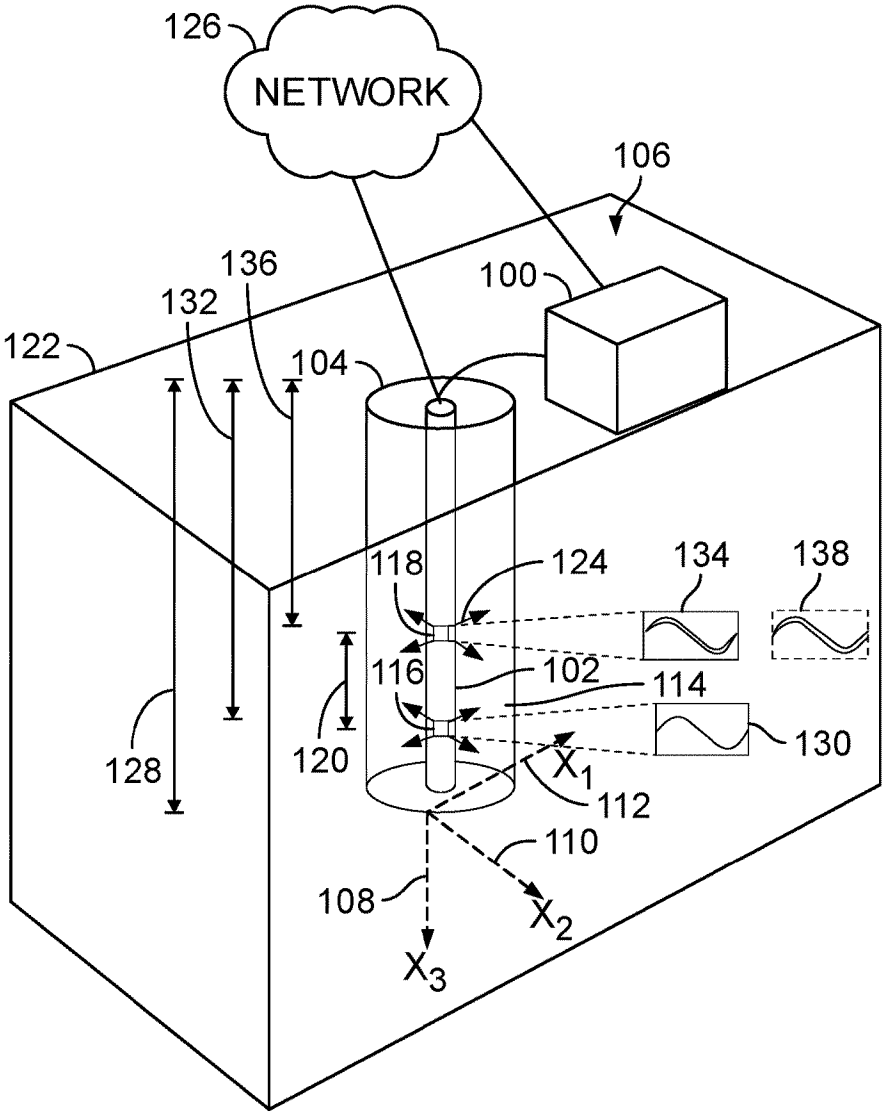
FIG. 1 is a schematic illustration depicting an example measurement manager apparatus measuring a property of a formation.

Methods, apparatus, and articles of manufacture to measure a formation characteristic are disclosed. An example apparatus includes a pre-processor to compare a first measurement obtained from a first sensor included in a logging tool at a first depth at a first time and a second measurement obtained from a second sensor included in the logging tool at the first depth at a second time; and a semblance calculator to: calculate a correction factor based on a difference between the first measurement and the second measurement; calculate a third measurement based on the correction factor and a fourth measurement obtained from the first sensor at a second depth at the second time; and a report generator to generate a report including the third measurement.

An example method includes comparing a first measurement obtained from a first sensor included in a logging tool at a first depth at a first time and a second measurement obtained from a second sensor included in the logging tool at the first depth at a second time; calculating a correction factor based on a difference between the first measurement and the second measurement; calculating a third measurement based on the correction factor and a fourth measurement obtained from the first sensor at a second depth at the second time; and generating a report including the third measurement.

An example non-transitory computer readable storage medium comprising instructions which, when executed, cause a machine to at least: compare a first measurement obtained from a first sensor included in a logging tool at a first depth at a first time and a second measurement obtained from a second sensor included in the logging tool at the first depth at a second time; calculate a correction factor based on a difference between the first measurement and the second measurement; calculate a third measurement based on the correction factor and a fourth measurement obtained from the first sensor at a second depth at the second time; and generate a report including the third measurement.

An example apparatus includes a collection engine to collect a first measurement obtained from a first sensor included in a logging tool at a first time at a first depth of a borehole penetrating a formation and one or more second measurements obtained from a second sensor included in the logging tool, and a semblance calculator to calculate a semblance factor based on a correlation coefficient between the first measurement and the one or more second measurements to identify a time delay between the first sensor and the second sensor. The semblance factor is to correlate the one or more second measurements to the first measurement for a maximum semblance value. A speed and depth calculator is provided to determine a tool speed from the time delay and the axial distance and to calculate a corrected tool depth based on the determined tool speed. The example apparatus also includes a report generator to generate a report including reconstruction of the first measurement and the one or more second measurements based on the corrected tool depth.

An example method includes collecting a first measurement obtained from a first sensor included in a logging tool at a first time at a first depth of a borehole penetrating a formation and one or more second measurements obtained from a second sensor included in the logging tool, the second sensor is spaced an axial distance from the first sensor in the logging tool. The method also includes calculating a semblance factor based on a correlation coefficient between the first measurement and the one or more second measurements to identify a time delay between the first sensor and the second sensor. The semblance factor is to correlate the one or more second measurements to the first measurement for a maximum semblance value. In the example method, a tool speed is determined from the time delay and the axial distance, while a corrected tool depth is calculated based on the determined tool speed. In the example method, a report is generated including reconstruction of the first measurement and the one or more second measurements based on the corrected tool depth.

An example non-transitory computer readable storage medium comprising instructions which, when executed, cause a machine to at least collect a first measurement obtained from a first sensor included in a logging tool at a first time at a first depth of a borehole penetrating a formation and one or more second measurements obtained from a second sensor included in the logging tool, the second sensor is spaced at an axial distance from the first sensor in the logging tool. The example non-transitory computer readable medium comprising instructions, when executed, cause the machine to calculate a semblance factor based on a correlation coefficient between the first measurement and the one or more second measurements to identify a time delay between the first sensor and the second sensor. The semblance factor is to correlate the one or more second measurements to the first measurement for a maximum semblance value. The example non-transitory computer readable storage medium comprising instructions which, when executed, cause the machine determine a tool speed from the time delay and the axial distance, calculate a corrected tool depth based on the determined tool speed, and generate a report including reconstruction of the first measurement and the one or more second measurements based on the corrected tool depth.

The oil and gas industry uses tools such as Logging While Drilling (LWD) tools, Measurement While Drilling (MWD) tools, wireline tools, etc., to measure a physical property of a formation. MWD tools can perform measurements and transmit data corresponding to the measurements to the surface in real time. For example, the MWD tools can transmit the data to the surface by means of a pressure wave (e.g., mud pulsing). LWD tools can perform measurements and record data corresponding to the measurements in memory and export the data or download the data to a computing device when the LWD tools reach the surface.

In some examples, logging tools such as LWD tools, MWD tools, wireline tools, etc., can measure physical properties of a formation while drilling including pressure, temperature, and wellbore trajectory in three-dimensional space. In some examples, the logging tools can measure formation parameters or measurements corresponding to the geological formation while drilling. For example, the logging tools may generate ultrasonic reflection and transmission, resistivity, porosity, sonic velocity, gamma ray, etc., measurements during a drilling operation. In some examples, the logging tools may conduct measurements of borehole geometries and physical formation properties in the vicinity of the borehole surface at high spatial sampling, and generate borehole images of respective or combined measurements. The tool may acquires borehole data in time series with an azimuth orientation referring magnetometer, while sensors on the tool scan the borehole surface. The data is decimated into a scan line or azimuthal array data of a length J having a corresponding angular resolution of 360°/J, where J is an integer equal to or larger than 1. Each scan line of data has one timestamp representative of the scan, for example, time of first or last line or array data, or an average of the entire scan line.

Typically, the tools include a bottom hole assembly (BHA) or a lower portion of the drill string. In some examples, the BHA includes one or more of a bit, a bit sub, a mud motor, a stabilizer, a drill collar, a heavy-weight drill pipe, a jarring device, a crossover, or one or more sensors. For example, the BHA may include a MWD tool, a LWD tool, etc., to measure formation features. For example, the BHA may be lowered into a borehole of a formation and a sensor included in the BHA may measure a feature of the formation. In some examples, the sensor is a pressure sensor, a temperature sensor, an acoustic source, an acoustic receiver or an acoustic transceiver. Alternatively, the sensor may be any other type of sensor to measure a feature of a formation. As used herein, the terms "feature" or "formation feature" refer to a characteristic of a formation (e.g., a physical property of the formation, a measurement characteristic of the formation, etc.) in the vicinity of borehole surface, at a downhole depth based on a measurement of one or more sensors included in a BHA. For example, a formation feature may include signal amplitude data, signal traveling time, signal propagation velocity, signal frequency data, pressure data, temperature data, electromagnetic measurement data, etc. For example, a formation feature may correspond to a signal amplitude, a plurality of signal amplitudes, a plurality of signal amplitudes or their processed or interpreted data as a function of time, depth, etc.

Recordings of one or more physical quantities in or around a well as a function of depth and/or time are known as logs. Logs include measurements of electrical properties (e.g., resistivity and conductivity at various frequencies), acoustic properties (e.g., amplitude and travel time of pulse-echo measurements, amplitude and travel time of pitch-catch measurements, slowness from array measurements at various frequencies), active and passive nuclear measurements, dimensional measurements of the wellbore, formation fluid sampling, formation pressure measurement, wireline-conveyed sidewall coring tools, etc., and/or a combination thereof. Information obtained from logs may be useful in a variety of applications, including well-to-well correlation, porosity determination, and determination of mechanical or elastic rock parameters.

Prior examples of using downhole tools to generate logs based on measured formation features include determining a borehole depth or a downhole depth at which the formation features were measured. In prior examples, surface (or apparent downhole) depth is estimated at the surface of a drilling platform by calculating a drill string length by adding a length of a BHA and a drill pipe length. An estimate of a drill bit position (e.g., a bottom-most portion of the BHA) or the BHA position can be computed based on a traveler block position and the drill string length. In some examples, a measurement can be obtained by a sensor included in the BHA. In some examples, the measurement is recorded with a first timestamp of a first clock in the BHA at downhole data sampling time. In some examples, along with the downhole measurement, a surface depth is recorded with a second timestamp of a second clock in a surface system at surface sampling time. In some examples, the downhole measurement can be mapped to the surface depth referring to the corresponding timestamps (e.g., the first timestamp is mapped to the second timestamp).

In prior examples, inaccurate or erroneous depth mapping of measurements corresponding to formation features occur when the drill string, i.e., the BHA and corresponding drill pipes is/are subject to depth discrepancy events. As used herein, a depth discrepancy event is a mechanical event of compression or extension in the drill string, resulting from stick and slip, substantial changes in weight-on-bit, torsional force, hydrostatic pressure differences between the inner and outer annulus of drill pipes, temperature change, etc. The mechanical event can result in discrepancies between the surface depth and the actual downhole depth of the sensors in the borehole. The mismatch in surface and downhole depths may degrade quality of borehole images or lead to inaccurate formation feature characterizations. For example, a dip angle and thickness of a formation layer or a fracture orientation at a specific depth may be inaccurately determined because their images are distorted due to a surface depth of each azimuthal scanline being different than its corresponding actual downhole depth.

In some examples, the mismatched depth reduces spatial measurement resolution because some measurements at some depths may be removed from the log in an image data conversion process from time to depth domain because the imaging tool generates an image log using a constant size pixel or depth bin size in the depth-domain by decimating redundant scanlines that are recorded in one depth bin. For example, an image or data generated from the wrong depth mapping process may be used to make an incorrect interpretation of the features due to inaccurate representation of their geometries. The mismatched depth may result in inaccurate formation characterizations, wellbore operation recommendations, etc., because an operator may not be aware that the image and data corresponds to incorrect depths.

Examples disclosed herein include a measurement manager apparatus to measure formation features by adjusting for depth discrepancies experienced by a logging tool. In some examples, the measurement manager apparatus obtains measurements from two sensors separated by a controlled axial offset. In some examples, the measurement manager apparatus can map the measurements to a depth corresponding to time at which the measurements and surface depth data are taken. In some examples, the measurement manager apparatus identifies formation features at a downhole depth corresponding to data obtained by one or more sensors. For example, the measurement manager apparatus may identify a first sensor or a leading sensor and a second sensor or a lagging sensor included in a BHA of the logging tool. In some examples, the leading sensor is closer to a bottom portion of the BHA compared to the lagging sensor.

In some examples, at a first downhole depth at a first time, the measurement manager apparatus identifies a first feature as a feature measured by the leading sensor at the first downhole depth at the first time. At a second downhole depth deeper than the first downhole depth and at a second time later than the first time, the example measurement manager apparatus identifies (1) a second feature measured by the leading sensor at the second downhole depth at the second time and (2) a third feature measured by the lagging sensor at the first downhole depth at the second time. The third feature corresponds to a repeat measurement of the first feature measured by the leading sensor at the first downhole depth.

In some examples, the measurement manager apparatus compares formation features at a downhole depth. In some examples, two sensors on a BHA acquire borehole and formation properties as azimuthal scanline data with timestamps while the BHA is descending or ascending in a borehole, in a depth interval from d1 (e.g., a first downhole depth) to d2 (e.g., a second downhole depth). In some examples, the depths d1 and d2 are key node depths, which are reliable reference depths from, for example, a downhole wellbore survey, or gamma logging (e.g., measuring gamma radiation from formations). In some examples, the two sensors are positioned in the outer surface of the BHA at a controlled axial offset of $\Delta D$ (e.g., difference between d1 and d2). Image data of each sensor may be pre-processed to enhance borehole features, for example, by equalizing data for transducer sensitivity, applying image processing techniques known as equalization, denoising, edge enhancement, image filtering (such as median, hybrid median, minimum, maximum or band-pass filter in the space-domain at an adequate band-pass frequency) to extract the formation features of interest, etc. One example azimuthal scan line (and timestamp) data of the leading sensor, which is indexed J, is compared or correlated to one example scan line data of the lagging sensor in the entire or partial depth interval of d1 to d2. The maximum correlation or semblance is found at scan line K of the lagging sensor. Time delay, $\Delta t$ at index J, is time elapsed between the first sensor and the second sensor passing over the same borehole depth. From the sensor offset $\Delta D$ and the time delay $\Delta t$, average tool speed or rate of penetration can be computed as, $RoP(J)=\Delta D/\Delta t$. Computed RoP value is measured speed at the mid-point of two sensors, and integrated speed over the time is measured depth, corrected for the tool speed between d1 and d2, which is equal to tripped distance of the tool or a theoretical example depth of $d2-d1-\Delta D$. Due to possible errors included in the semblance calculation and averaging over finite discrete time and sensors at discrete distance, integrated speed may differ from the theoretical value. In such a case, the measured depth may be scaled by applying an example scaling factor in such a way that the scaled measured depth matches the theoretical value. The measured data from two sensors in the time-domain can be mapped to the depth being corrected for the tool speed.

In some examples, the measurement manager apparatus compares formation features in data at a time. For example, the measurement manager apparatus may compare the formation features to determine whether the formation features substantially correlate to each other (e.g., formation features are identified as being associated with each other based on using one or more correlation techniques), substantially match each other (e.g., substantially match each other within a tolerance range, a degree of accuracy, etc.), etc.

In some examples, the measurement manager apparatus may compare (1) the first feature at the first downhole depth at the first time to (2) the third feature at the first downhole depth at the second time. In response to determining that the first and the third features substantially match based on the comparison, the example measurement manager apparatus determines that a depth discrepancy event did not occur at the second time because the second sensor measured the substantially same feature at the second time as the first sensor measured at the first time. In response to determining that features associated with the second time are not associated with a depth discrepancy event, the example measurement manager apparatus validates the first feature and/or identifies the first feature to be included in the log. In some examples, the measurement manager apparatus also validates the second feature and/or identifies the second feature to be included in the log because the second feature was measured substantially simultaneously at the second time with the third feature.

In some examples, in response to determining that the first feature and the third feature do not match, the example measurement manager apparatus calculates a correction factor (e.g., an adjustment factor, a scaling factor, a reduction ratio, an extension ratio, a stretching ratio, etc.) based on a comparison of the first feature and the first third feature. For example, the measurement manager apparatus may determine that a depth discrepancy event occurred causing the leading and lagging sensors to measure different features at the same recorded depth. In response to determining that the first feature and the third feature do not substantially match based on the comparison, the example measurement manager apparatus may determine that the second feature is also affected because the second feature was measured at the same time as the third feature. In some examples, the measurement manager apparatus adjusts and/or otherwise corrects the second feature (e.g., corrects the data associated with the second feature) using the correction factor. In response to correcting the second feature, the example measurement manager apparatus may identify the corrected second feature to be included in the log.

In some examples, in response to determining depth based on an average tool speed computation, the example measurement manager apparatus may determine a tool speed substantially deviates from a tool speed computed using timestamps or neighboring scanlines, as a result of erratic correlation of scanlines using semblance of the scan lines from the leading and lagging sensors. Substantially deviated tool speed can be identified by applying statistical processing to tool speed data such as, for example, standard deviation calculations. In such a case, the example measurement manager apparatus may use averaged tool speed of neighboring scanlines. Alternatively, the example measurement manager apparatus may compute semblance of plural azimuthal scanlines instead of one. The number of scanlines can be parameterized in the measurement manager apparatus.

FIG. 1 is a schematic illustration depicting an example measurement manager 100 communicatively coupled to an example logging tool 102 operating in a borehole 104 (e.g., a wellbore) in a sub-surface formation 106. The formation 106 of the illustrated example can contain a desirable fluid such as oil or gas. In the illustrated example, the borehole 104 is a vertical wellbore (e.g., parallel to an X3-axis 108) drilled in the formation 106. Although the borehole 104 is depicted as a vertical wellbore in FIG. 1, alternatively, the borehole 104 may be a deviated wellbore (e.g., parallel to an X2-axis 110) or a horizontal wellbore (e.g., parallel to an X1-axis 112). The example borehole 104 may be used to extract the desirable fluid. Alternatively, the example borehole 104 may be filled with a borehole fluid 114 such as a drilling fluid.

In the illustrated example of FIG. 1, the logging tool 102 is disposed in the borehole 104. The logging tool 102 of the illustrated example is a LWD tool. Alternatively, the example logging tool 102 may be any other type of logging tool such as a MWD tool, a wireline logging tool, etc.

In the illustrated example of FIG. 1, the logging tool 102 includes two sensors 116, 118. Alternatively, the example logging tool 102 may include more than two sensors. The first and second sensors 116, 118 of FIG. 1 are separated by an axial offset 120. In FIG. 1, the first sensor (S1) 116 and the second sensor (S2) 118 are ultrasonic sensors. For example, the first and second sensors 116, 118 may measure an acoustic reflectivity of the formation 106 at the formation and borehole fluid interface and caliper borehole diameter from the borehole 104 at one or more downhole depths. Alternatively, the first and second sensors 116, 118 may be resistivity sensors, pressure sensors, temperature sensors, gamma-ray sensors, nuclear sources, vibration sensors, etc., or any other type of sensor(s) capable of measuring a property of the formation 106. In some examples, the first and second sensors 116, 118 measure formation properties utilizing the same physics principles, which does not limit combinations of any one of them, for example, acoustic reflectivity—resistivity. In some examples, the first and second sensors 116, 118 of the illustrated example can be representative of sensors that perform array measurements and which are configured to transmit energy (e.g., a transmitter array that excites broadband energy) in a form of directional acoustic waves 124 or directional electromagnetic waves 124 into the formation 106. Alternatively, the first and second sensors 116, 118 may receive energy in any other form from the formation 106, for example, an array of ultrasonic receivers or a pitch-catch measurement device. In some examples, the first and second sensors 116, 118 are transceivers, which are capable of transmitting energy into the formation 106 and receiving reflected or back scattering energy from the formation 106. In some examples, the first and second sensors 116, 118 are receivers, which can receive energy from the formation 106 to determine a formation feature.

In the illustrated example of FIG. 1, the logging tool 102 is communicatively coupled to the measurement manager 100, which is located above or on a surface 122 of the formation 106. Additionally or alternatively, the example measurement manager 100 may be included in the logging tool 102. In some examples, the measurement manager 100 obtains measurement information from the logging tool 102. As used herein, the term "measurement information" refers to unprocessed and/or processed data corresponding to measurements of one or both sensors 116, 118 of FIG. 1. For example, the measurement manager 100 may obtain measurement information including acoustic reflectivity, acoustic velocity, resistivity, porosity, gamma ray, etc., information corresponding to a feature of the formation 106. In another example, the measurement information may include corresponding timestamps, and/or estimated downhole depths based on a depth tracking system included in the measurement manager 100 (e.g., positions of the first and second sensors 116, 118).

In the illustrated example of FIG. 1, the logging tool 102 is communicatively coupled to a network 126. The example network 126 of the illustrated example of FIG. 1 is the Internet. However, the example network 126 may be implemented using any suitable wired and/or wireless network(s) including, for example, one or more data buses, one or more Local Area Networks (LANs), one or more wireless LANs, one or more cellular networks, one or more satellite networks, one or more private networks, one or more public networks, etc. In some examples, the network 126 enables the example measurement manager 100 to be in communication with the example logging tool 102. For example, the measurement manager 100 may obtain measurement information from the logging tool 102 via the network 126.

In some examples, the network 126 enables the logging tool 102 to communicate with an external computing device (e.g., a database, a server, etc.) to store the measurement information obtained by the logging tool 102. In such examples, the network 126 enables the measurement manager 100 to retrieve and/or otherwise obtain the stored measurement information for processing. As used herein, the phrase "in communication," including variances therefore, encompasses direct communication and/or indirect communication through one or more intermediary components and does not require direct physical (e.g., wired) communication and/or constant communication, but rather includes selective communication at periodic or aperiodic intervals, as well as one-time events.

In some examples, the measurement manager 100 analyzes and/or otherwise processes measurement information obtained by the first and second sensors 116, 118 at a plurality of depths of the borehole 104 to measure a feature of the formation 106. In FIG. 1, the first sensor 116 is a leading sensor 116 and the second sensor 118 is a lagging sensor 118. The leading sensor 116 is closer to a bottom portion of the logging tool 102 compared to the lagging sensor 118. In FIG. 1, the logging tool 102 is at a first downhole depth 128, which corresponds to a depth of the bottom of the logging tool 102 with respect to the surface 122.

In FIG. 1, at the first downhole depth 128, the example measurement manager 100 obtains a first measurement at a first time from the leading sensor 116 corresponding to a first feature 130 at a first position 132, where the first position 132 is a position of the leading sensor 116 in the borehole 104 with respect to the surface 122 of the formation 106. At the first downhole depth 128, the example measurement manager 100 obtains a second measurement at the first time from the lagging sensor 118 corresponding to a second feature 134 at a second position 136, where the second position 136 is a position of the lagging sensor 118 in the borehole 104 with respect to the surface 122.

In some examples, the measurement manager 100 validates features of the formation 106 based on comparing features measured by the first and second sensors 116, 118. For example, the measurement manager 100 may compare (1) the second feature 134 measured by the lagging sensor 118 at the second position 136 to (2) a third feature 138 measured by the leading sensor 116 when the leading sensor 116 is at the second position 136 at a second time, where the first time is after the second time.

In some examples, the measurement manager 100 validates the first feature 130 measured by the leading sensor 116 at the first position 132 at the first time based on the second feature 134 and the third feature 138 substantially matching. For example, the measurement manager 100 may identify the first feature 130 to be included in a log generated by the measurement manager 100 when the second feature 134 and the third feature 138 substantially correlate to each other and, thus, indicate that the logging tool 102 did not experience a depth discrepancy event resulting from a mechanical event (e.g., sticking, slipping, etc., of the logging tool 102) at the second time.

In some examples, the measurement manager 100 adjusts the first feature 130 in response to determining that the second feature 134 and the third feature 138 do not match. For example, the measurement manager 100 may determine that the logging tool 102 experienced a depth discrepancy event at the second time. For example, the measurement manager 100 may determine that the first and second sensors 116, 118 are measuring the same feature but at different indicated depths of the formation 106 resulting from a mechanical event associated with lowering the logging tool 102 deeper into the borehole 104. In response to determining that the second feature 134 and the third feature 138 do not substantially correlate and/or substantially match, the example measurement manager 100 may determine that the first feature 130 is also affected.

In some examples, the measurement manager 100 calculates a correction factor based on a comparison of the second feature 134 to the third feature 138. In some examples, the measurement manager 100 determines a corrected feature, corrected measurement information, etc., at the first position 132 based on the first feature 130 and the calculated correction factor. In some examples, the measurement manager 100 identifies the corrected feature, the corrected measurement information, etc., to be included in a log generated by the measurement manager 100.

In some examples, the measurement manager 100 generates a recommendation based on the log. For example, the measurement manager 100 may generate a recommendation to perform an operation (e.g., a wellbore operation) on the borehole 104 based on the log. For example, the recommendation may be a wellbore operation recommendation, proposal, plan, strategy, etc. An example wellbore operation may include performing a cementing operation, a coiled-tubing operation, a hydraulic fracturing operation, deploying, installing, or setting a packer (e.g., a compression-set packer, a production packer, a seal bore packer, etc.), etc., and/or a combination thereof. In prior examples, improper recommendations may have been generated due to measured features being recorded at incorrect depths. In some examples, the measurement manager 100 improves recommendations based on an increased confidence in features of the formation 106 being mapped to correct downhole depths, adjusting measurement information associated with features recorded at incorrect depths, etc.

In some examples, the measurement manager 100 generates a recommendation including a proposal to initiate, perform, proceed, pursue, etc., one or more wellbore operations. For example, the measurement manager 100 may generate a recommendation including a proposal to perform a wellbore operation such as installing a packer based on the log. For example, the measurement manager 100 may generate a recommendation including a proposal to perform a wellbore operation in response to the measurement manager 100 characterizing the formation 106 at one or more specified depths based on an improved confidence of information included in the log representing substantially accurate measurement information.

In some examples, the measurement manager 100 generates a recommendation including a proposal to abort one or more wellbore operations. For example, the measurement manager 100 may generate a recommendation including a proposal to abort a performance of a wellbore operation such as a hydraulic fracturing operation based on the log. For example, the measurement manager 100 may generate a recommendation including a proposal to abort a forecasted wellbore operation in response to the measurement manager 100 characterizing the formation 106 at one or more specified depths based on an improved confidence of information included in the log representing substantially accurate measurement information.

Figure 2:
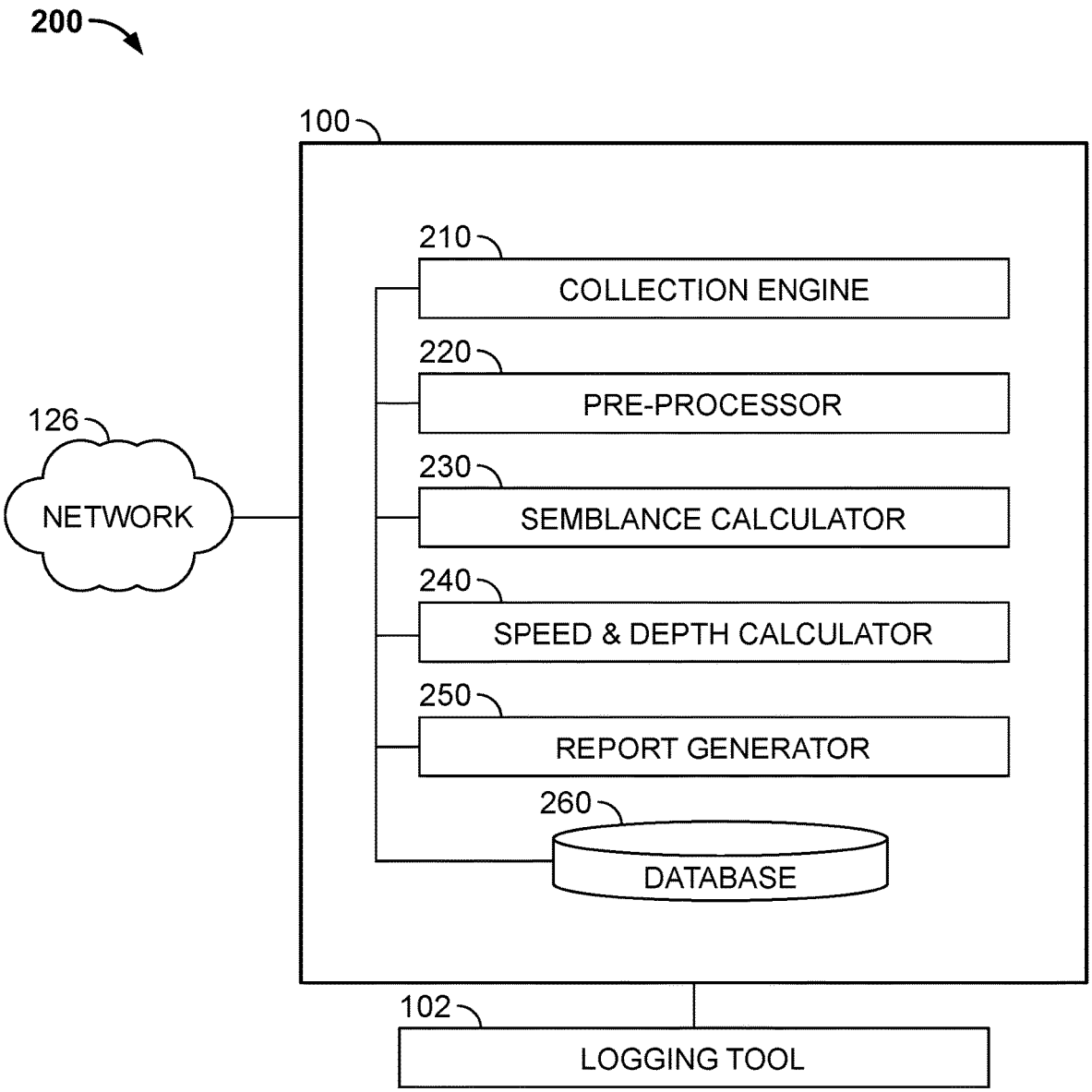
FIG. 2 is a block diagram of an example implementation of the example measurement manager apparatus of FIG. 1.

FIG. 2 is a block diagram of an example implementation of the measurement manager 100 of FIG. 1. FIG. 2 depicts an example measurement management system 200 including the example measurement manager 100 of FIG. 1 communicatively coupled to the example network 126 of FIG. 1 and the example logging tool 102 of FIG. 1.

In FIG. 2, the example measurement management system 200 obtains measurement information from the logging tool 102 and/or the network 126 and includes features corresponding to the measurement information in a log based on validating the features. In FIG. 2, the example measurement manager 100 includes an example collection engine 210, an example pre-processor 220, an example semblance calculator 230, an example speed and depth calculator 240, an example report generator 250, and an example database 260.

In the illustrated example of FIG. 2, the measurement manager 100 includes the collection engine 210 to obtain information acquired by the logging tool 102 of FIG. 1. For example, the collection engine 210 may obtain measurement information corresponding to the first feature 130, the third feature 138, and/or the second feature 134 of FIG. 1. In some examples, the collection engine 210 obtains data directly from the logging tool 102. In some examples, the collection engine 210 obtains data from the logging tool 102 when the logging tool 102 is in operation in the borehole 104. In some examples, the collection engine 210 obtains data from the logging tool 102 when the logging tool 102 is out of the borehole 104. For example, the collection engine 210 may download data from the logging tool 102 when the logging tool 102 is not in operation and/or otherwise in the borehole 104.

In some examples, the collection engine 210 determines when to obtain the data from the logging tool 102. In some examples, the collection engine 210 selects a depth of interest to process. For example, the collection engine 210 may select the first downhole depth 128 to process associated measurement information to generate a log. In some examples, the collection engine 210 determines whether to continue monitoring the logging tool 102. For example, the collection engine 210 may determine to discontinue monitoring the logging tool 102 when the logging tool 102 has completed a wellbore monitoring operation.

In some examples, the collection engine 210 obtains data from the logging tool 102 via the network 126 of FIG. 1. In some examples, the collection engine 210 obtains measurement information corresponding to the first feature 130, the third feature 138, the second feature 134, etc., associated with the formation 106. For example, the collection engine 210 may obtain measurement information captured by the first and second sensors 116, 118 corresponding to features of the formation 106. In some examples, the collection engine 210 stores information (e.g., obtained measurement information acquired by the logging tool 102) in the database 260 and/or retrieves information from the database 260.

In the illustrated example of FIG. 2, the measurement manager 100 includes the pre-processor 220 to pre-process the collected data from the collection engine 210 and to prepare the collected data for subsequent processing by the measurement manager 100. In some examples, the pre-processor 220 enhances and/or otherwise extracts features by applying image or array data processing to raw data in two dimensions, for example, azimuth-time. In some examples, the raw data may contain background noise or artifacts not relevant to formation properties. For example, amplitude and travel time of an ultrasonic pulse-echo signal may vary in low spatial frequency due to standoff change or varying distance between the borehole surface and the sensors 116, 118 due to the tool 102 dynamically moving or being eccentric relative to the borehole 104. An eccentering artifact may be removed by applying spatial high-pass filtering or a discrete cosine transform (DCT). In some examples, the raw data may have low contrast change related to formation features and may require enhancement to increase sensitivity for data correlation. In some examples, the enhancement can be done by digitizing the data values at lower amplitude resolution thresholds, such as binarization where one threshold value is present. In some examples, when the raw amplitude of data from the lagging sensor 118 is different from the raw amplitude of data from the leading sensor 116 due to a difference in sensitivities, the pre-processor 220 may adjust the amplitude by applying a gain factor based on a ratio of nominal amplitude of each sensor 116, 118, such as, for example, median average. In some examples, the processed collected data at timestamp k may be one or a plurality of azimuthal scan line data near the timestamp k, for example, from k−m to k+m (m can be any integer equal or larger than 0). The measurement manager 100 may determine the parameter m based on logging conditions such as average rate of penetration at the surface and tool rotation.

In some examples, the pre-processor 220 generates a feature of the formation 106 of FIG. 1 based on mapping measurement information to a depth and/or a timestamp. In some examples, the pre-processor 220 generates and/or otherwise identifies formation features at a downhole depth. For example, the pre-processor 220 may map first measurement information obtained from the leading sensor 116 to the first downhole depth 128 of the logging tool 102 and/or the first position 132 of the leading sensor 116. In response to the mapping, the example pre-processor 220 may generate the first feature 130. In another example, the pre-processor 220 may map second measurement information obtained from the lagging sensor 118 to the first downhole depth 128 and/or the second position 136 of the lagging sensor 118. In response to the mapping, the example pre-processor 220 may generate the second feature 134.

In the illustrated example of FIG. 2, the measurement manager 100 includes the semblance calculator 230 to determine similarity between data (e.g., the processed collected data from the pre-processor 220) from the leading sensor 116 and the lagging sensor 118 of FIG. 1. In some examples, the semblance calculator 230 determines a semblance factor based on a coherence of the data from the first and second sensors 116, 118, or alternatively a difference between the data from the first and second sensors 116, 118. In some examples, the data that is fed into the semblance factor computation of the semblance calculator 230 is feature enhanced data from the pre-processor 220, which does not limit feeding raw or alternatively processed data. In some examples, the coherence is a ratio of coherent energy to the total energy of the data for the first and second sensors 116, 118. The difference is a ratio of energy (e.g., a difference of the total energy of the first sensor 116 data to the total energy of the second sensor 118). The semblance calculator 230 calculates a semblance factor of the leading sensor 116 to the lagging sensor 118 based on the coherence ratio, for example.

In some examples, the semblance calculator 230 calculates a correction factor, in addition to or separate from the semblance factor, based on the features 130, 134, 138. In some examples, the correction factor is an extension factor, which can be used to scale up or increase measurement information. In some examples, the correction factor is a reduction factor, which can be used to scale down or reduce measurement information. In some examples, the semblance calculator 230 calculates a correction factor based on comparing features. For example, the semblance calculator 230 may calculate a correction factor by comparing the second feature 134 to the third feature 138. For example, the semblance calculator 230 may calculate the correction factor by calculating a ratio of the second feature 134 and the third feature 138. In some examples, the semblance calculator 230 generates a correction factor for a plurality of downhole depths. For example, the semblance calculator 230 may generate a first correction factor for the second feature 134 and the third feature 138 associated with measurement information at the first downhole depth 128, a second correction factor for one or more features associated with measurement information at a second downhole depth, etc. Additionally or alternatively, the example semblance calculator 230 may calculate the correction factor using one or more of any other algorithm, method, operation, process, etc.

In the illustrated example of FIG. 2, the measurement manager 100 includes the speed and depth calculator 240 to correct and/or otherwise adjust measurement information associated with a feature. In some examples, the speed and depth calculator 240 adjusts measurement information based on a correction factor. For example, the speed and depth calculator 240 may adjust the first feature 130 or measurement information associated with the first feature 130 using the correction factor. For example, the speed and depth calculator 240 may calculate an adjusted or a corrected formation feature based on a multiplication or other mathematical operation of the first feature 130 and the correction factor.

In the illustrated example of FIG. 2, the measurement manager 100 includes the report generator 250 to generate and/or prepare reports. In some examples, the report generator 250 generates a report including a log. For example, the report generator 250 may generate a log including measurement information as a function of depth and/or time. In some examples, the report generator 250 generates one or more recommendations. For example, the report generator 250 may generate a report including a recommendation to initiate or abort a wellbore operation.

In some examples, the report generator 250 generates an alert such as displaying an alert on a user interface, propagating an alert message throughout a process control network, generating an alert log and/or an alert report, etc. For example, the report generator 250 may generate an alert corresponding to the first feature 130 and the second feature 134 at the first downhole depth 128 of the formation 106 based on whether measurement information associated with the first feature 130 and/or the second feature 134 satisfy one or more thresholds. In some examples, the report generator 250 stores information (e.g., a log, an alert, a recommendation, etc.) in the database 260 and/or retrieves information from the database 260.

In the illustrated example of FIG. 2, the measurement manager 100 includes the database 260 to record data (e.g., measurement information, correction factors, logs, recommendations, etc.). The example database 260 may be implemented by a volatile memory (e.g., a Synchronous Dynamic Random Access Memory (SDRAM), Dynamic Random Access Memory (DRAM), RAMBUS Dynamic Random Access Memory (RDRAM), etc.) and/or a non-volatile memory (e.g., flash memory). The example database 260 may additionally or alternatively be implemented by one or more double data rate (DDR) memories, such as DDR, DDR2, DDR3, mobile DDR (mDDR), etc. The example database 260 may additionally or alternatively be implemented by one or more mass storage devices such as hard disk drive(s), compact disk drive(s) digital versatile disk drive(s), etc. While in the illustrated example the database 260 is illustrated as a single database, the database 260 may be implemented by any number and/or type(s) of databases. Furthermore, the data stored in the database 260 may be in any data format such as, for example, binary data, comma delimited data, tab delimited data, structured query language (SQL) structures, etc.

While an example manner of implementing the measurement manager 100 of FIG. 1 is illustrated in FIG. 2, one or more of the elements, processes, and/or devices illustrated in FIG. 2 may be combined, divided, re-arranged, omitted, eliminated, and/or implemented in any other way. Further, the example collection engine 210, the example pre-processor 220, the example semblance calculator 230, the example speed and depth calculator 240, the example report generator 250, the example database 260, and/or, more generally, the example measurement manager 100 of FIG. 1 may be implemented by hardware, software, firmware, and/or any combination of hardware, software, and/or firmware. Thus, for example, any of the example collection engine 210, the example pre-processor 220, the example semblance calculator 230, the example speed and depth calculator 240, the example report generator 250, the example database 260, and/or, more generally, the example measurement manager 100 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)), and/or field programmable logic device(s) (FPLD(s)). When reading any of the apparatus or system claims of this patent to cover a purely software and/or firmware implementation, at least one of the example collection engine 210, the example pre-processor 220, the example semblance calculator 230, the example speed and depth calculator 240, the example report generator 250, and/or the example database 260 is/are hereby expressly defined to include a non-transitory computer readable storage device or storage disk such as a memory, a digital versatile disk (DVD), a compact disk (CD), a Blu-ray disk, etc., including the software and/or firmware. Further still, the example measurement manager 100 of FIG. 1 may include one or more elements, processes, and/or devices in addition to, or instead of, those illustrated in FIG. 2, and/or may include more than one of any or all of the illustrated elements, processes, and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 3:
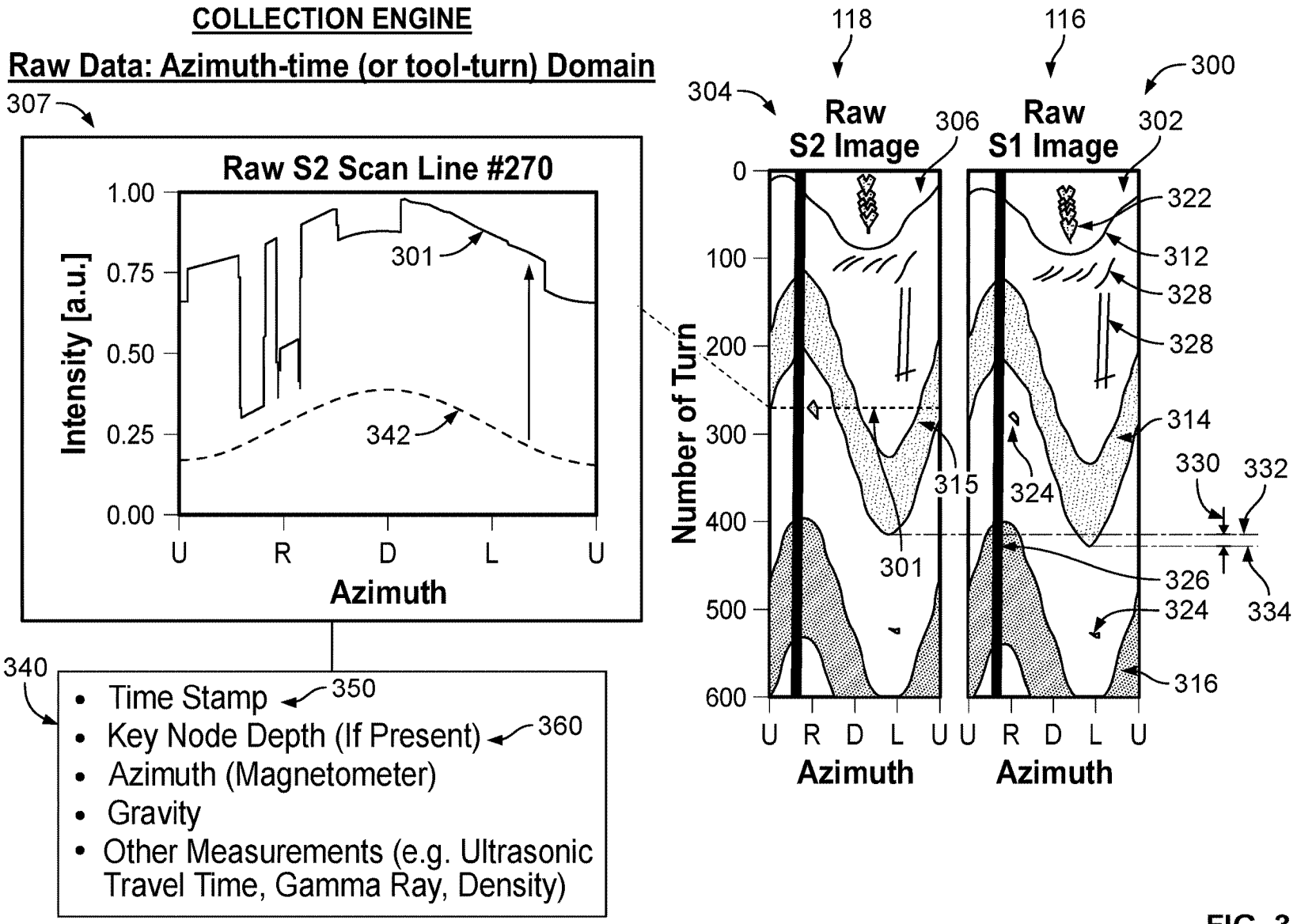
FIG. 3 is a schematic illustration of the example measurement raw data that is acquired by the collection engine of FIG. 2, presenting example borehole and formation features in image log format.

FIG. 3 is a schematic illustration of example raw data that is acquired by the collection engine 210, illustrating example borehole and formation features in image log format. FIG. 3 depicts a first example log 300 including first measurement information 302 measured by the first sensor 116 of FIG. 1 and a second example log 304 including second measurement information 306 measured by the second sensor 118 of FIG. 1. In the illustrated example of FIG. 3, the first example log 300 includes borehole and formation features in a two-dimensional plane of azimuth—number of tool-turns or tool-rotation images, including, for example, a natural fracture 312, a first formation layering 314 and a second formation layering 316 with some dipping angles, borehole damage examples of breakouts 322, drilling-induced shear failures 324, a drilling-induced fracture 326 and drill bit and stabilizer markings 328, that can be observed in borehole images. In the illustrated example of FIG. 3, the borehole and formation features remain unchanged during a substantially short time interval in which the first and second sensors 116, 118 traverse over identical features one after another. In the illustrated example of FIG. 3, the example measurement information 302 and the example log 306 include a plurality of azimuthal scan line data 301, which is acquired every tool turn or rotation by the first and second sensors 116, 118 during the drilling operation. In the illustrated example, one scan line data 301 is extracted and depicted as an example raw scan line data 307. In some examples, each scan line data (e.g., the scan line data 301, the raw scan line data 307) may include azimuthally binned or decimated measurement attributes, for example, amplitude of ultrasonic pulse-echo signal, that are acquired via magnetometer readings that indicate azimuthal tool orientation. In some examples, each scan line data may also have associated measurement data 340, for examples, tool orientation information based on magnetometer readings and earth gravity, and/or other measurements such as travel time of ultrasonic pulse-echo signal, gamma ray and resistivity that is acquired at identical or substantially in short time from an example timestamp 350. In the first and second logs 300, 304, borehole images show azimuthal background intensity gradation 344, which may be an artifact of sensor standoff variation resulting in low spatial frequency sinusoidal intensity variation 342 depicted in the azimuthal scan line data graph 307. The intensity gradation 344 is not necessarily a borehole feature and may appear differently between the first and second sensors 116, 118, and among scan line data of each of the first and/or second sensors 116, 118. In the first and second logs 300 and 304, the borehole features are offset along the vertical axis. For example, a first scan line 332 is located at the lower end of the first formation layering 314 visible in the first log 300, and a second scan line 334 is located at the lower end of corresponding first formation layering 315 visible in the second log 304. In the illustrated example, a gap 330 is formed between the first measurement information 302 and the second measurement information 306 due to a time delay or difference of corresponding timestamps of the scan lines 332, 334, and is attributed to an average rate of penetration (RoP) or tool speed along borehole axis and the axial offset 120 of the sensors 116, 118 in the logging tool 102 of FIG. 1.

Figure 4:
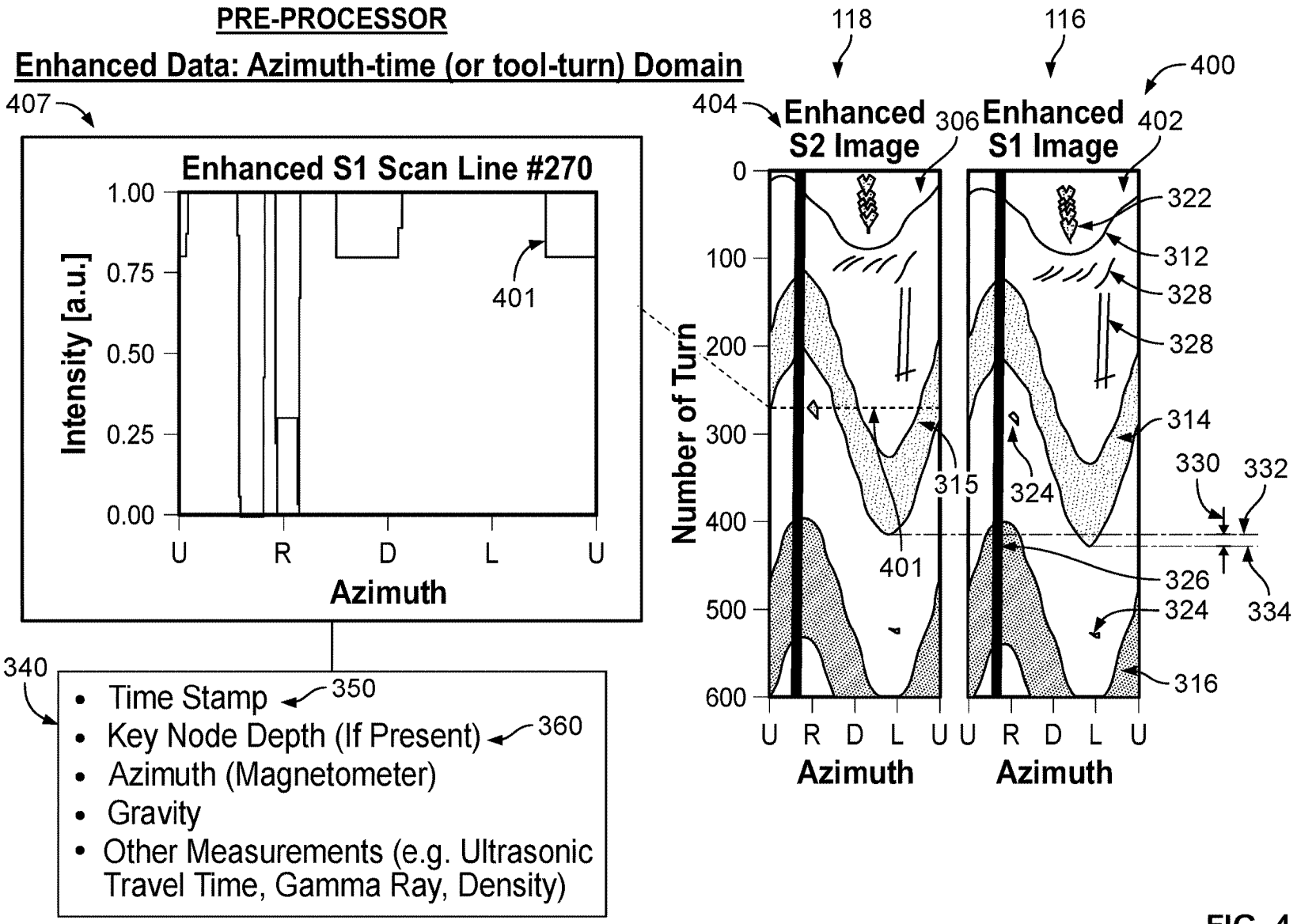
FIG. 4 depicts an example enhancement of borehole and formation features by the preprocessor of FIG. 2.

Turning to FIG. 4, example enhancement of borehole and formation features are illustrated. In the illustrated example, the logs 300, 304 in FIG. 3 are pre-processed by the pre-processor 220 to improve intensity contrast of the first example data 302 and the second example data 306, for example, removing sinusoidal background 342 in the scan line data 307, and scaled to maximize intensity variation of the borehole and formation features in FIG. 3. Alternatively, enhancement by the pre-processor 220 can be done by applying one or any combination of common image processing techniques such as, for example, denoising, histogram equalization, median, maximum, minimum filtering, and edge enhancement and binarization in azimuth—scan-line domain, or in the spatial frequency domain after processing image data applying discrete cosine transform or continuous wavelet transform. In the illustrated example of FIG. 4, enhanced data 406 of the second sensor 118 is presented in an enhanced log 404, and enhanced data 402 of the first sensor 116 is presented in another enhanced log 400. The borehole and formation features (312, 314, 322, 324, 326, 328) in FIG. 4 are clearly visible in the enhanced logs 400, 404. One example of scan line data 401 of the enhanced data 406 of the second sensor 118 is depicted in a graph 407. In the graph 407, contrast of intensity is higher than the original scan line data 301 presented in corresponding graph 306 in FIG. 3. The enhanced measurement information 402, 406 is stored in the database 260 in FIG. 2, and can be read from the database 260 when needed.

Figure 5A:
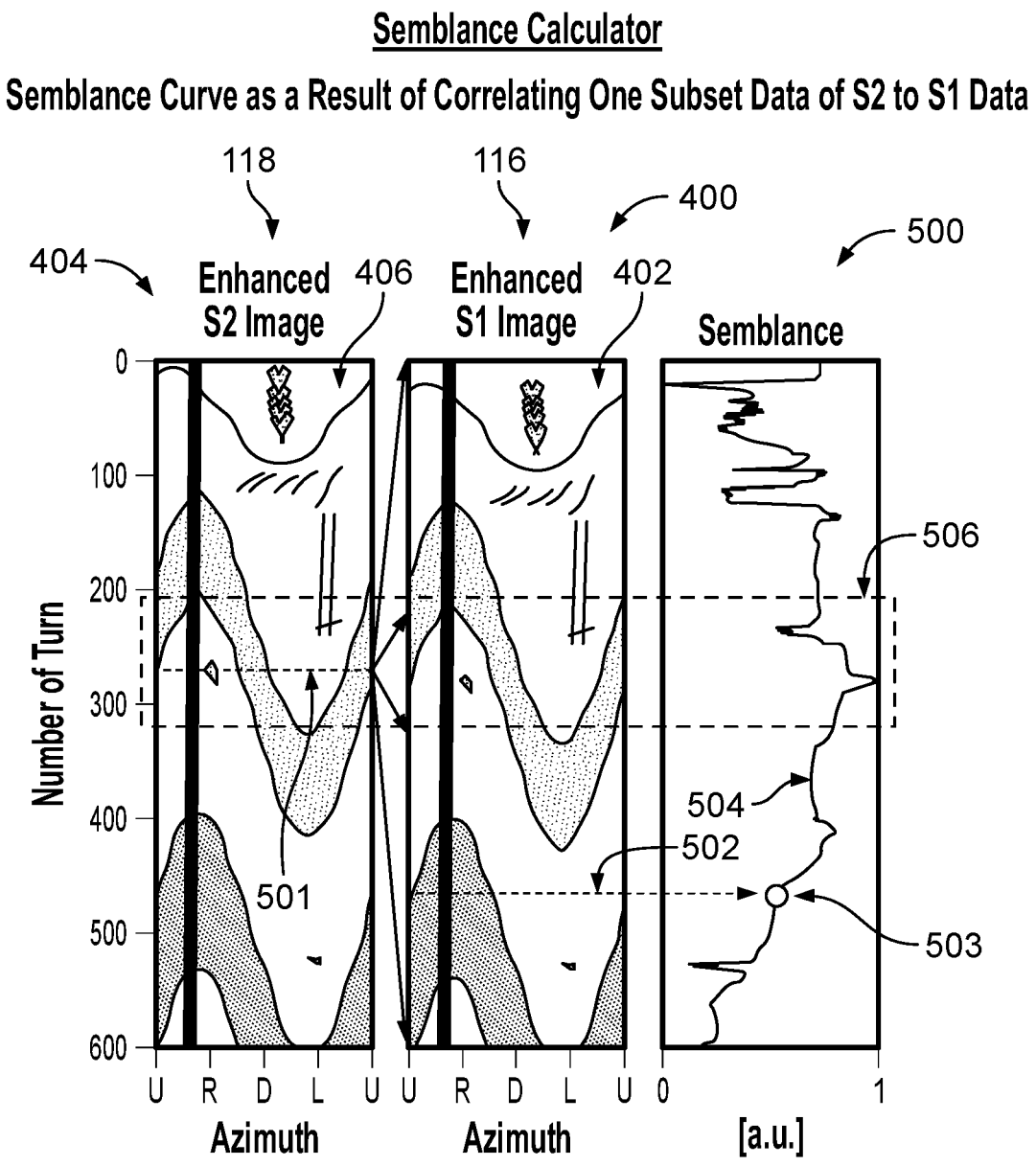
FIGS. 5A-5B illustrate an example semblance computation process in the semblance calculator of FIG. 2.
Figure 5B:
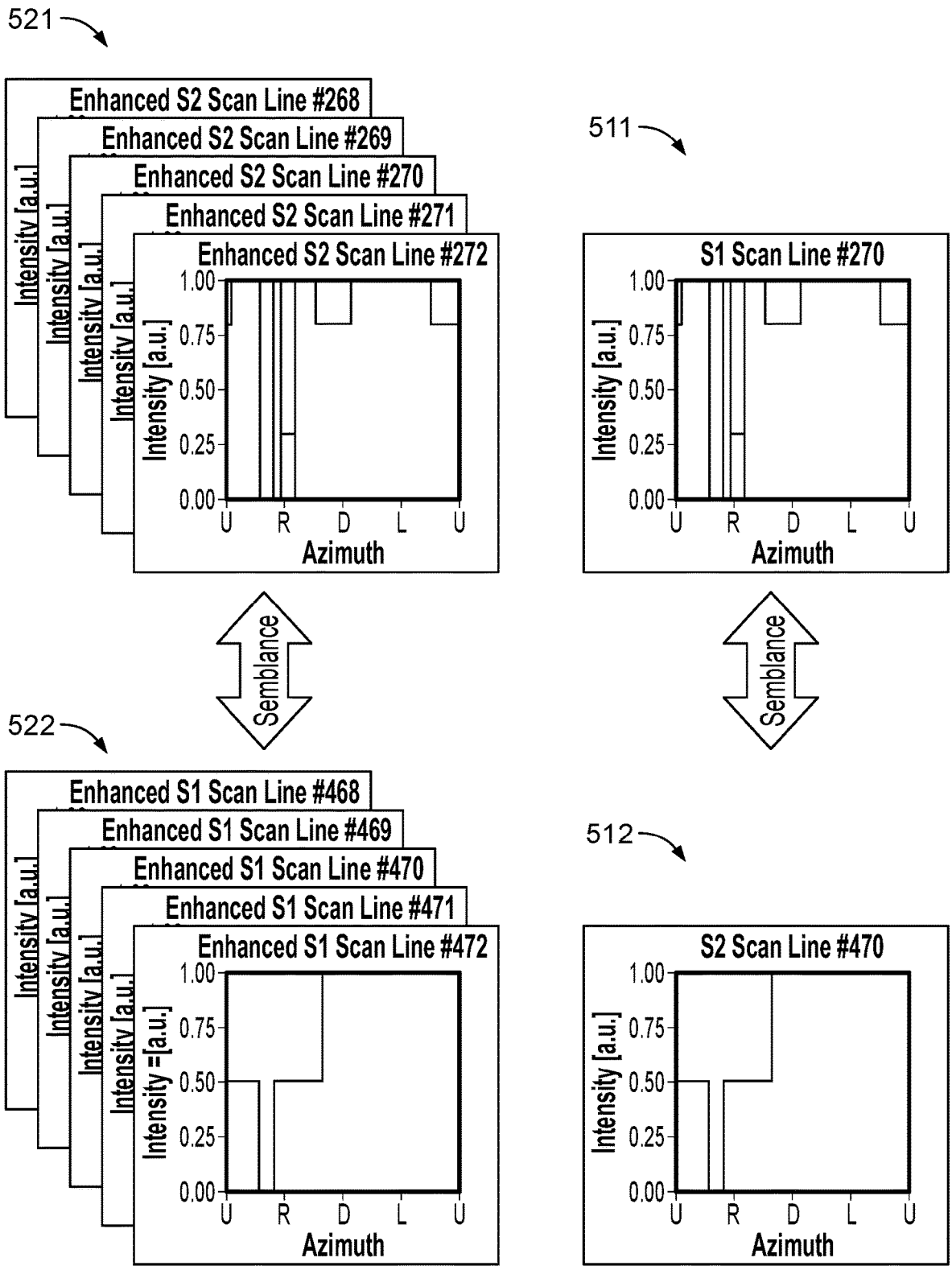

FIGS. 5A-5B illustrate an example semblance computation process in the semblance calculator 230. The semblance calculator 230 prepares the pre-processed data from the pre-processor 220 at an example number of turns 501 (e.g., approximately 275 turns) of the second enhanced measurement information 406 of the second sensor 118 and another example number of turns 502 (e.g., approximately 475 turns) of the second enhanced measurement information 402 of the first sensor 116. In the illustrated example, data obtained at the example number of turns 501 of the second measurement information 406 can be illustrated as one scan line data 511 or multiple scan line data 521 centered at the number of turns 502 including a pre-determined number of neighboring scan lines. In a similar manner, data obtained at the number of turns 502 of the first measurement information 402 can be illustrated as one scan line 512 or multiple scanlines 522 centered at the number of turns 502 of interest. In the illustrated example, the semblance calculator 230 determines semblance (e.g., square-magnitude coherence) using the identical number of scan lines of data from the first and second sensors 116, 118, for example, the data of one scan line 511, 512 or multiple scan lines 521, 522 of FIG. 5. In the illustrated example, a semblance factor value 503, corresponding to the data at the example scan line 501 and the data at the example scan line 502, is computed by the semblance calculator 230. The semblance calculator 230 repeats semblance factor computation, either over the entire or a subset of the enhanced measurement data 402 of the first sensor 116 in FIG. 1 and outputs a semblance curve 504 in an example semblance log 500. The semblance curve 504 may be stored in the database 260 of FIG. 2. In the illustrated example, the maximum semblance value is located in one example interval 506 of FIG. 5.

Figure 6:
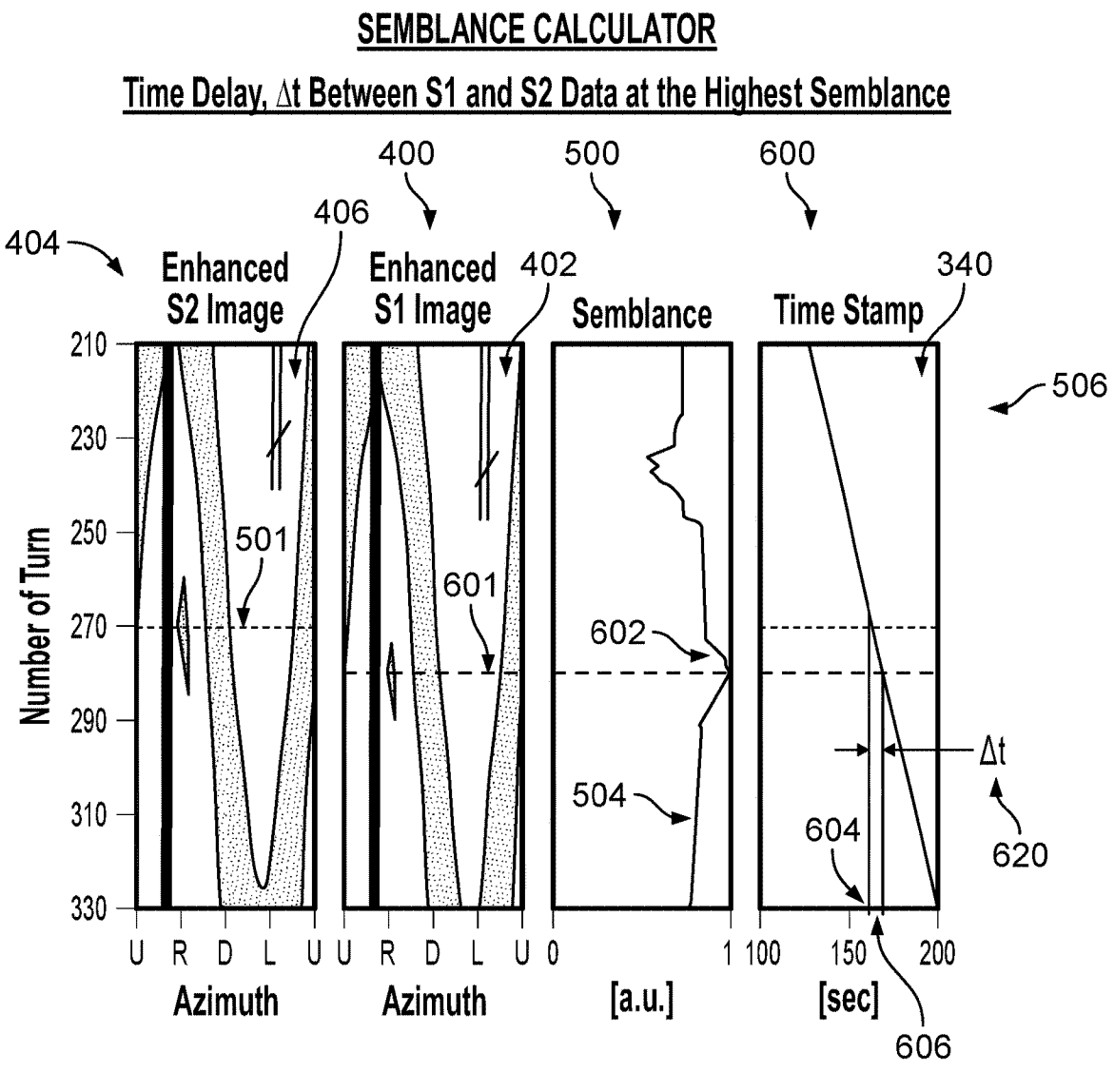
FIG. 6 depicts the example interval of the logs in FIG. 5.
Figure 6:
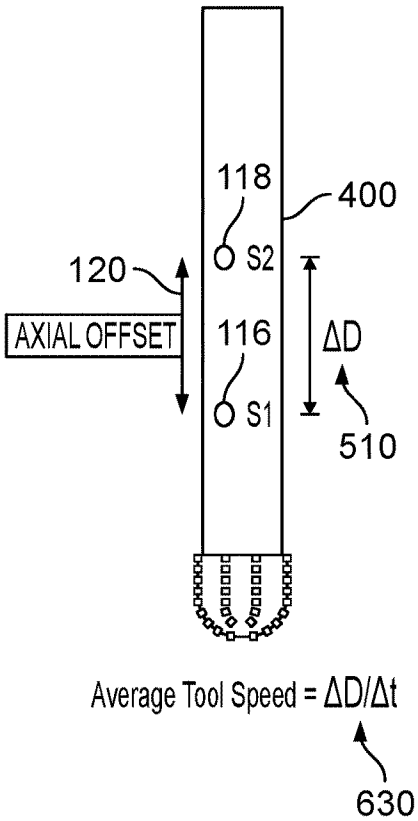

FIG. 6 illustrates the example interval 506 of the logs in FIG. 5. At the example number of turns 501 of the second enhanced measurement information 406, the coherence curve 504 takes the maximum value at one example number of turns 601 of the first enhanced measurement information 402. The first enhanced measurement data at the example number of turn 501 has one example timestamp 604 as shown in the time log 600 generated from the timestamp data 340 in FIG. 3. The second enhanced measurement data at the example number of turns 601 has an example timestamp data 606. Using an example difference between the timestamps 604, 606, $\Delta t$ 620, and the sensor offset value $\Delta D$ 510, the semblance calculator 230 and/or the example speed and depth calculator 240 determines an average tool speed or average rate of penetration 630 as the offset 510 divided by the time difference 520. The semblance calculator 230 repeats the time delay $\Delta t$ 620 computation for every scan line of the enhanced measurement information 406 from the second sensor 118, then stores the time delay data 620 in the database 260 of FIG. 2.

Figure 7:
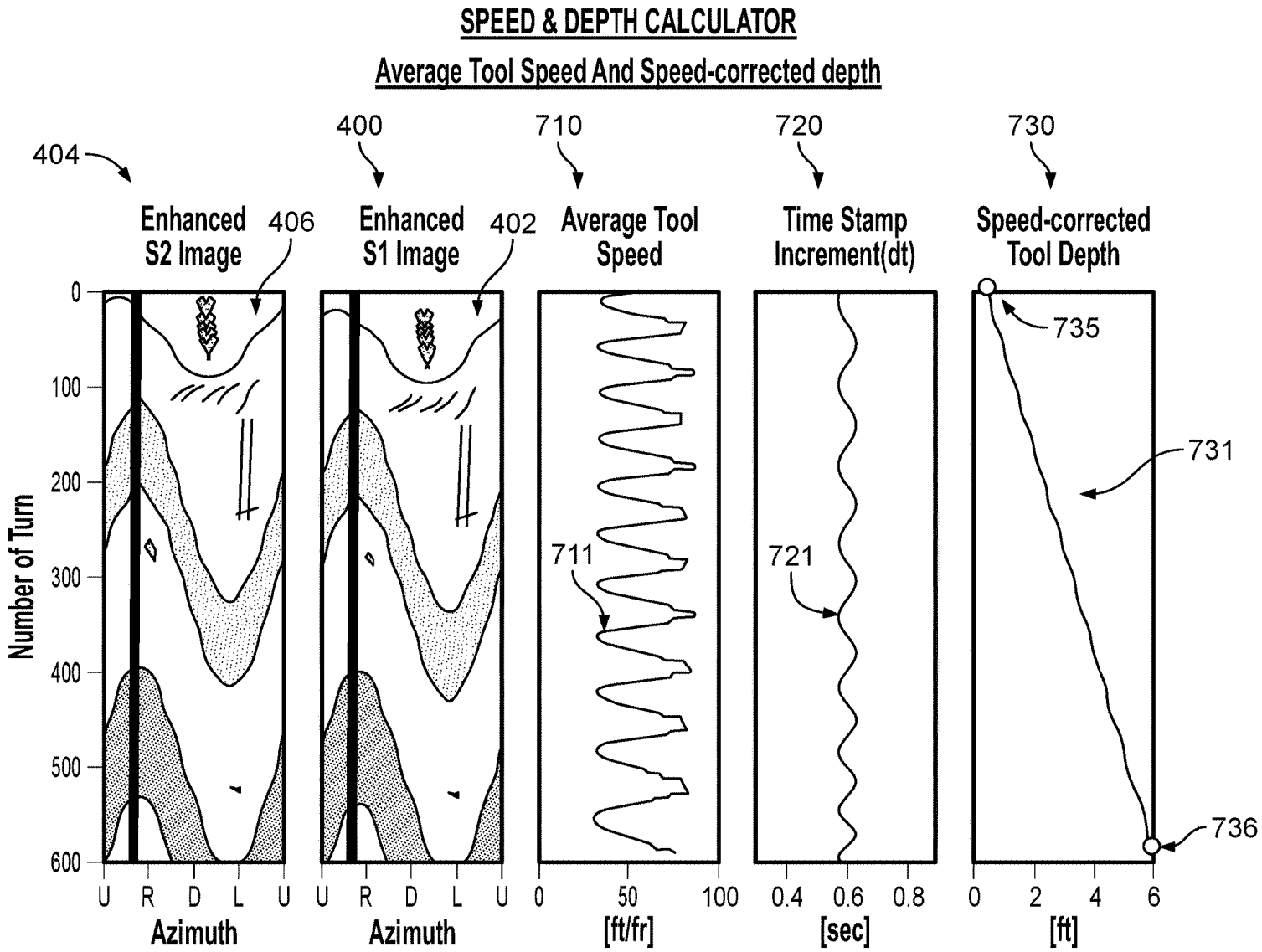
FIG. 7 illustrates an example output from the speed and depth calculator of FIG. 2.

FIG. 7 illustrates example output from the speed and depth calculator 240 of FIG. 2. The average tool speed is computed by dividing the sensor offset value 630 by the time delay ($\Delta t$) 620 between the scan lines of the first and second sensors 116, 118 at the maximum semblance in FIG. 6. The example resulting tool speed data is available and presented as example curve data 711 in an example tool speed log 710. From the timestamp data 340 available at every tool turn, the speed and depth calculator 240 determines time increment data 721 from the closest neighboring scan line and generates an example log 720. The speed and depth calculator 240 numerically integrates the example tool speed data 711 with the example time increment 721 to generate example tool speed-corrected depth data 731. The initial depth of speed-corrected depth 735 is provided as a known reference depth, for example, representing the end depth of a previous drilling process, or survey depth reference. In some examples, the speed-corrected depth is the initial depth 735 plus the previous value of integrated tool speed, which should be identical to a depth calculated at an end depth of a current drilling process or a survey depth after the current drilling process. If the calculated end depth 736 value deviates from the end depth of the reference drilling depth, the entire tool corrected data 731 may be scaled by applying a gain to make the last speed corrected depth data value 736 match the reference drilling end depth. The speed-corrected depth data 731 is stored in the database 260 of FIG. 2 to enable the depth data 731 to be retrieved when needed. In some examples, the speed-corrected depth 731 is to be used to represent the measurement information data of the first and second sensors 116, 118 in on-depth log. In some examples, the speed-corrected depth 731 may be used to map other measurements data 340 to borehole depth. In case the other measurements data 340 is acquired by a different tool or BHA, the speed-corrected depth 731 may have timestamps from different clocks that are used for the speed and depth calculator 240. However, the different absolute times from different tools or BHAs (e.g., one time difference for one tool, a second time difference for another tool, etc.) may be synchronized if the measurement data from the different tools or BHAs indicates a drilling start and end time, for example, by observed noise or signal features associated with respective measurements from the different tools or BHAs.

Figure 8:
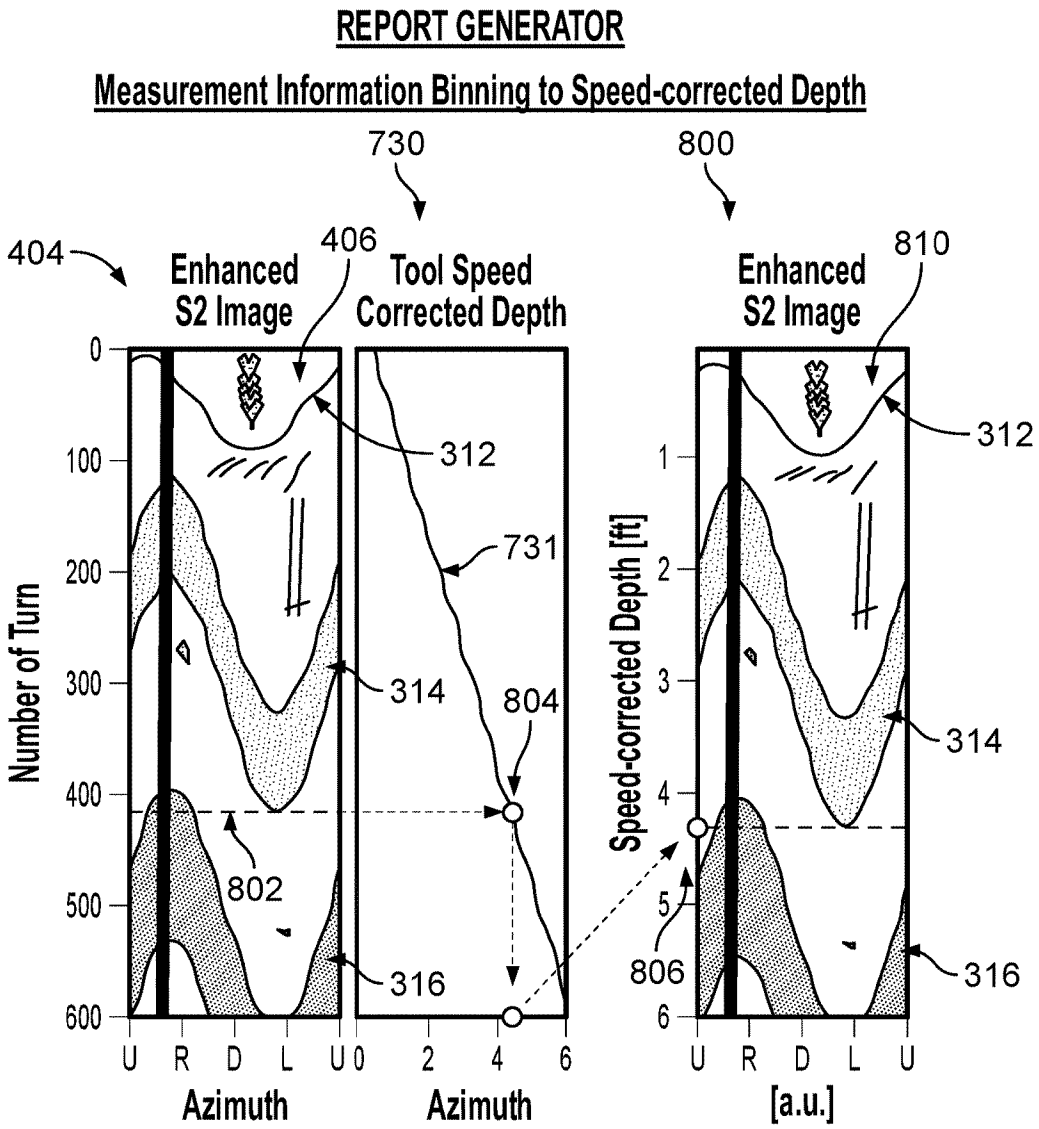
FIG. 8 depicts an example measurement depth mapping processing by the report generator in FIG. 2.

FIG. 8 depicts an example measurement depth mapping processing by the report generator 250 of FIG. 2. The report generator 250 reads the enhanced measurement information 406 of the second sensor 118, the tool speed-corrected depth data 731 from the database 260 and displays this information and data in the example logs 404 and 730. At one example number of tool turns 802, the report generator 250 identifies corresponding speed-corrected depth data 804. The report generator 250 identifies the depth value 806 and maps the scan line data to corresponding scan line of azimuth-depth image log 800. The report generator 250 repeats this depth binning process for every scan line of the enhanced measurement information 406. In some examples, the report generator outputs resulting data 810 in the image log 800 to illustrate borehole features, such as the natural fracture 312, the first formation layering 314 and the second formation layering 316 at minimized distortion. In some examples, distortion that was visible in the corresponding features 312, 314, 316 of the time-domain log 404, resulting from fluctuating tool speed and tool rotation, was not visible. The depth-sorted data 810 is stored in the database 260 of FIG. 2.

Figure 9:
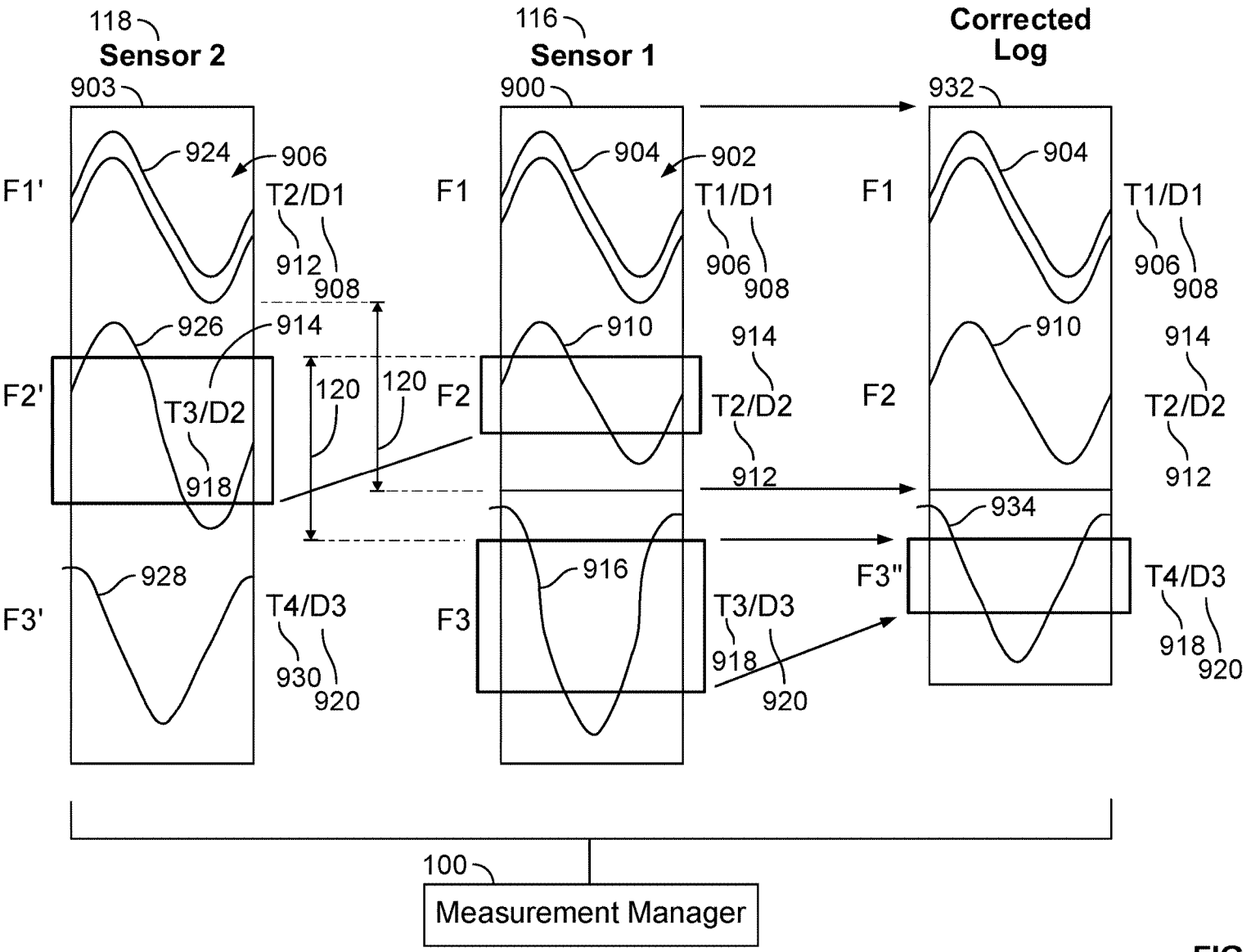
FIG. 9 is a schematic illustration of the example measurement manager apparatus of FIGS. 1-2 generating a log including example measurements corresponding to example formation features.

FIG. 9 is an example schematic illustration of the example measurement manager 100 of FIGS. 1-2 generating a corrected log 932 including example measurements corresponding to example formation features. FIG. 9 depicts a first example log 900 including first measurement information 902 measured by the first sensor 116 of FIG. 1 and a second example log 903 including second measurement information 906 measured by the second sensor 118 of FIG. 1. In FIG. 9, the first example log 900 includes first data associated with a first example feature (F1) 904 at a first time (T1) 906 and at a first depth (D1) 908. In FIG. 9, the first example log 900 includes second data associated with a second example feature (F2) 910 at a second time (T2) 912 and at a second depth (D2) 914. In FIG. 9, the first example log 900 includes third data associated with a third example feature (F3) 916 at a third time (T3) 918 and at a third depth (D3) 920. In FIG. 9, a difference in depth between D1 908 and D2 914 and the difference in depth between D2 914 and D3 920 corresponds to the axial offset 120 of the logging tool 102 of FIG. 1.

In FIG. 9, the second example log 903 includes fourth data associated with a fourth example feature (F1') 924 at the second time (T2) 912 and at the first depth (D1) 908. In FIG. 9, the second example log 903 includes fifth data associated with a fifth example feature (F2') 926 at the third time (T3) 918 and at the second depth (D2) 914. In FIG. 9, the second example log 903 includes sixth data associated with a sixth example feature (F3') 928 at a fourth time (T4) 930 and at the third depth (D3) 920.

In the illustrated example of FIG. 9, the first measurement information 902 associated with F2 910 is obtained substantially simultaneously with the second measurement information 906 associated with F1' 924. Similarly, in FIG. 9, the first measurement information 902 associated with F3 916 is obtained substantially simultaneously with the second measurement information 906 associated with F2' 926.

In FIG. 9, the example measurement manager 100 validates features measured by the first and second sensors 116, 118 of FIG. 1 to be included in the corrected log 932. In FIG. 9, the example measurement manager 100 validates F1 904 measured by the first sensor 116 by comparing F1 904 and F1' 924 at D1 908. In response to determining that F1 904 and F1' 924 substantially match, the example measurement manager 100 validates F1 904 and F2 910 by determining that F1 904 and F2 910 are substantially accurate representations of measurement information associated with the formation 106 of FIG. 1 at D1 908 and D2 914, respectively. The example measurement manager 100 may identify F1 904 and F2 910 to be included in the corrected log 932 based on validating F1 904 and F2 910.

In the illustrated example of FIG. 9, the example measurement manager 100 calculates a correction factor based on identifying a depth discrepancy event at T3 918. In FIG. 9, the example measurement manager 100 compares the validated F2 910 at T2 912 and at D2 914 to F2' 926 at T3 918 and at D2 914 and identifies a depth discrepancy event at T3 918 based on the comparison. For example, the measurement manager 100 may determine that F2 910 and F2' 926 do not substantially match, which indicates that a mechanical event occurred after T2 912 and, thus, affects the first and the second measurement information 902, 906 obtained at T3 918. In response to determining that there is a depth discrepancy event at T3 918, the example measurement manager 100 determines that F3 916 at T3 918 and at D3 920 is affected by the depth discrepancy event.

In FIG. 9, the example measurement manager 100 adjusts F3 916 by calculating a correction factor based on comparing F2 910 to F2' 926 at D2 914. For example, the measurement manager 100 may calculate the correction factor based on calculating a ratio of F2 910 and F2' 926. For example, the measurement manager 100 may calculate the correction factor based on calculating a ratio of the first measurement information 902 associated with F2 910 and the second measurement information 906 associated with F2' 926.

In FIG. 9, the correction factor is a reduction factor based on the first measurement information 902 at D2 914 including reduced information (e.g., decreased amplitudes, decreased signal strengths, decreased engineering values, etc.) compared to the second measurement information 906 at D2 914. In other examples, the measurement manager 100 may calculate an extension factor if the first measurement information 902 at a depth includes enlarged or amplified information (e.g., increased amplitudes, increased signal strengths, increased engineering values, etc.) compared to the second measurement information 906 at the depth.

In the illustrated example of FIG. 9, the measurement manager 100 adjusts F3 916 based on determining that F3 916 is affected by the depth discrepancy event at T3 918. The example measurement manager 100 adjusts and/or otherwise corrects for the depth discrepancy event at T3 918 by scaling F3 916 with the calculated reduction factor. In FIG. 9, the example measurement manager 100 calculates an adjusted feature (F3") 934 by applying the reduction factor to F3 916. In FIG. 9, the example measurement manager 100 identifies F3" 934 to be included in the corrected log 932.

Figure 10:
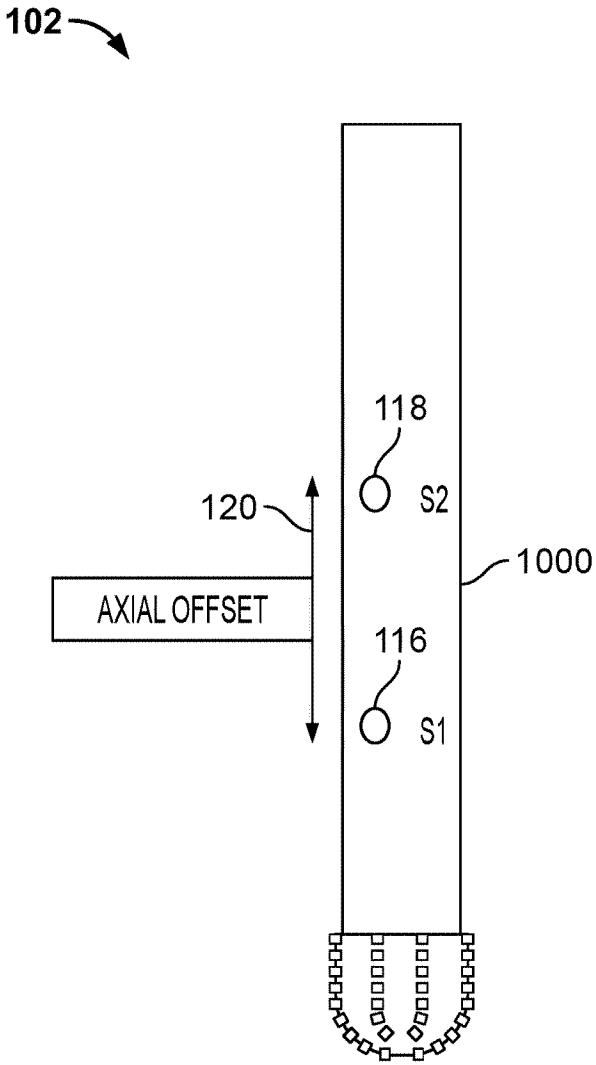
FIG. 10 depicts an example bottom hole assembly including two example sensors of FIG. 1.

FIG. 10 depicts an example bottom hole assembly (BHA) 1000 including the first sensor 116 and the second sensor 118 of FIG. 1. The example BHA 1000 corresponds to a lower portion of the logging tool 102 of FIG. 1. In FIG. 10, the first sensor 116 is at a first position and the second sensor 118 is at a second position, where the axial offset 120 of FIG. 1 separates the first position and the second position. For example, the axial sensor offset 120 has a value of ΔD 510 of FIG. 5, and ΔD must be greater than 0, preferably within a range from 2 to 100-times the required data sampling resolution along a borehole depth, which does not limit using a larger sensor axial offset. For example, if axial data sampling resolution is at 0.1 inch, preferred axial sensor offset is between 0.2 to 10 inches. In FIG. 10, the total number of offset sensors is 2. However, more than two sensors may be used to estimate tool speed if desired. In such a case, the average the tool speed may be estimated using a linear regression or mathematical or statistical (e.g., median) average. In some examples, the azimuthal orientations of the sensors 116, 118 are identical in the BHA 1000 of FIG. 10, which does not limit having the sensors at different azimuthal orientations.

Figure 11:
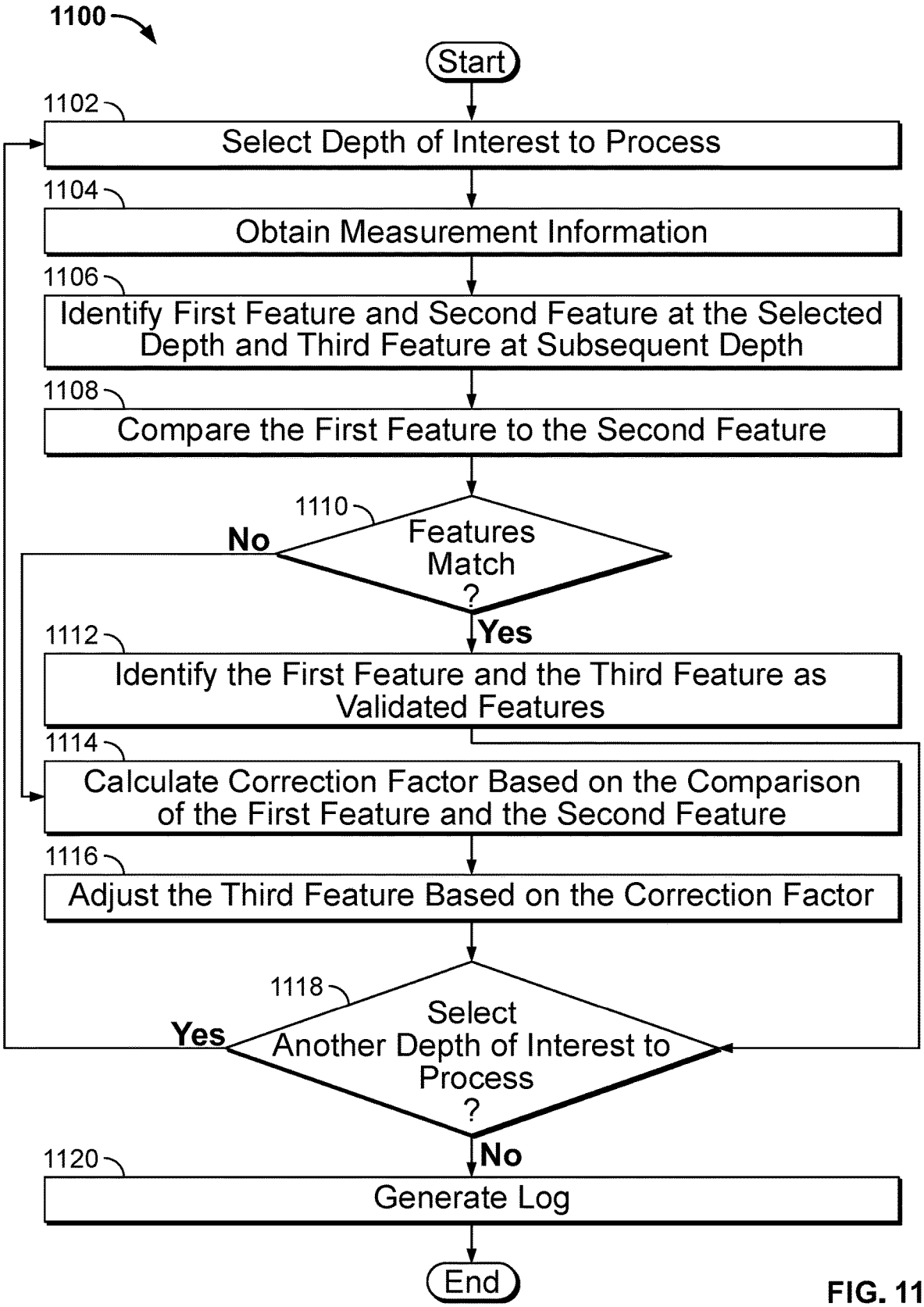
FIG. 11 is a flowchart representative of machine readable instructions that may be executed to implement the example measurement manager apparatus of FIGS. 1-2.
Figure 12:
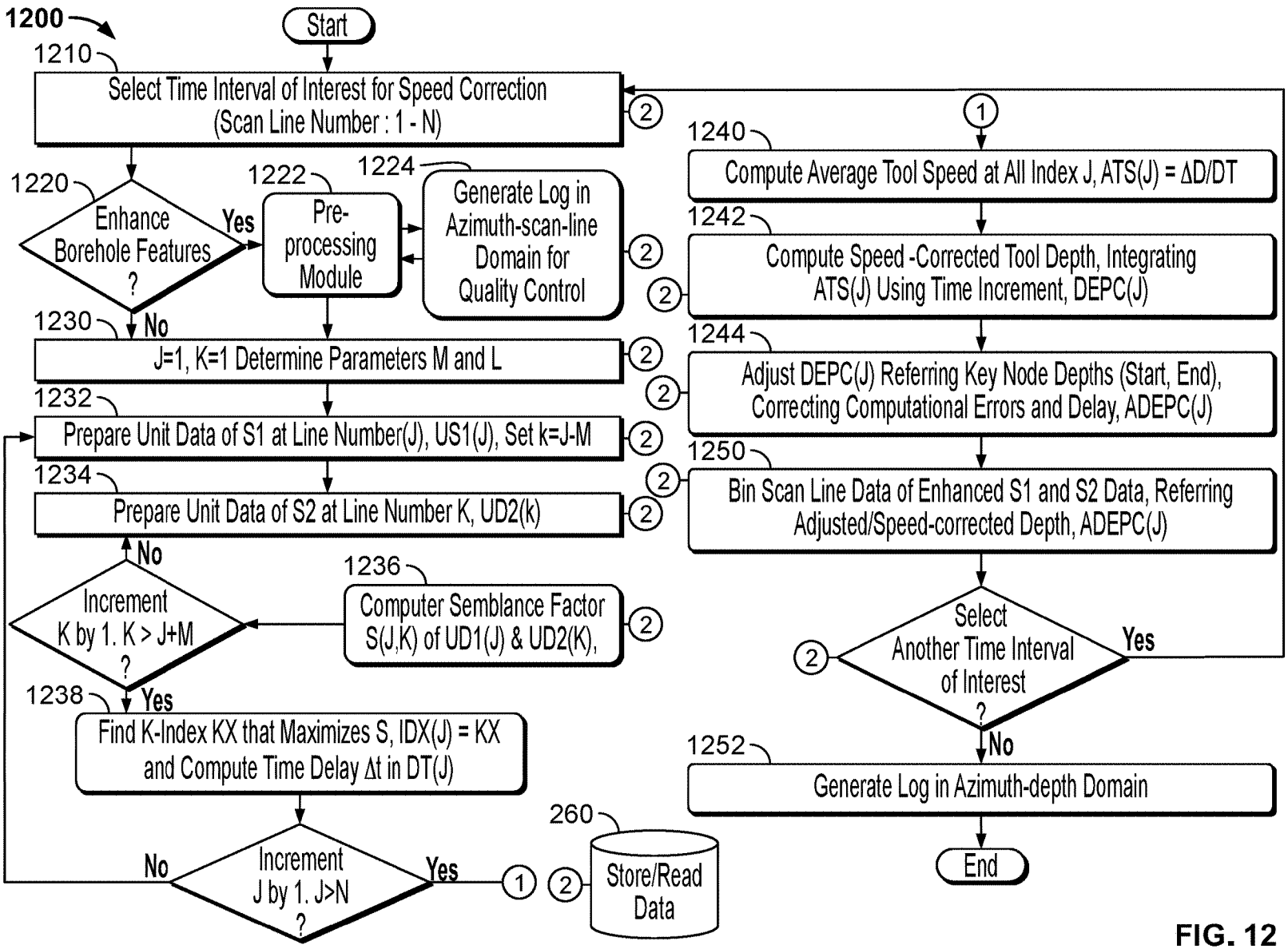
FIG. 12 is another flowchart representative of machine readable instructions that may be executed to implement the example measurement manager apparatus of FIGS. 1-2.

Flowcharts representative of example hardware logic or machine readable instructions for implementing the example measurement manager 100 of FIGS. 1-2 are shown in FIGS. 11 and 12. The machine readable instructions may be a program or portion of a program for execution by a processor such as the processor 1312 shown in the example processor platform 1300 discussed below in connection with FIG. 13. The program may be embodied in software stored on a non-transitory computer readable storage medium such as a CD-ROM, a floppy disk, a hard drive, a DVD, a Blu-ray disk, or a memory associated with the processor 1312, but the entire program and/or parts thereof could alternatively be executed by a device other than the processor 1312 and/or embodied in firmware or dedicated hardware. Further, although the example programs are described with reference to the flowcharts illustrated in FIGS. 11 and 12, many other methods of implementing the example measurement manager 100 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example processes of FIGS. 11 and 12 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory, and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, and (6) B with C.

FIG. 11 is a flowchart representative of an example method 1100 that may be performed by the example measurement manager 100 of FIGS. 1-2 to generate a log associated with the example formation 106 of FIG. 1. The example method 1100 begins at block 1102, at which the example measurement manager 100 selects a depth of interest to process. For example, the collection engine 210 may select D2 914 of FIG. 9 to process.

At block 1104, the example measurement manager 100 obtains measurement information. For example, the collection engine 210 may obtain the first log 900 and the second log 903 of FIG. 9 from the logging tool 102 of FIG. 1. For example, the collection engine 210 may obtain the first and second logs 900, 903 from the logging tool 102 when the logging tool 102 is removed from the borehole 104 of FIG. 1. For example, the collection engine 210 may obtain the first and second logs 900, 903, which are stored in the logging tool 102.

At block 1106, the example measurement manager 100 identifies a first feature and a second feature at the selected depth and a third feature at a subsequent depth. For example, the pre-processor 220 may identify F2 910 at D2 914, F2' 926 at D2 914, and F3 916 at D3 920 of FIG. 9.

At block 1108, the example measurement manager 100 compares the first feature to the second feature. For example, the semblance calculator 230 may compare F2 910 at D2 914 to F2' 926 at D2 914.

At block 1110, the example measurement manager 100 determines whether the features match. For example, the semblance calculator 230 may determine that F2 910 and F2' 926 do not substantially match each other indicating that a depth discrepancy event occurred at T3 918. In such an example, the semblance calculator 230 may determine that the F3 916 is affected by the depth discrepancy event. In another example, the semblance calculator 230 may determine that F2 910 and F2' 926 do substantially correlate indicating that a depth discrepancy event did not occur at T3 918.

If, at block 1110, the example measurement manager 100 determines that the features do not match, control proceeds to block 1114 to calculate a correction factor based on the comparison of the first feature and the second feature. If, at block 1110, the example measurement manager 100 determines that the features match, then, at block 1112, the measurement manager 100 identifies the first feature and the third feature as validated features. For example, the report generator 250 may identify F2 910 and F3 916 to be included in the corrected log 932 of FIG. 9. In response to the example measurement manager 100 identifying the first feature and the third feature as validated features, control proceeds to block 1118 to determine whether to select another depth of interest to process.

At block 1114, the example measurement manager 100 calculates a correction factor based on the comparison of the first feature and the second feature. For example, the semblance calculator 230 may calculate a correction factor by calculating a ratio of F2 910 and F2' 926.

At block 1116, the example measurement manager 100 adjusts the third feature based on the correction factor. For example, the speed and depth calculator 240 may calculate F3" 934 of FIG. 9 based on F3 916 and the correction factor. In such an example, the report generator 250 may identify F3" 934 to be included in the corrected log 932.

At block 1118, the example measurement manager 100 determines whether to select another depth of interest to process. For example, the collection engine 210 may determine to select D3 920 to process. In another example, the collection engine 210 may determine that there are no additional depths of interest to process.

If, at block 1118, the example measurement manager 100 determines to select another depth of interest to process, control returns to block 1102 to select another depth of interest to process. If, at block 1118, the example measurement manager 100 determines not to select another depth of interest, then, at block 1120, the measurement manager 100 generates a log. For example, the report generator 250 may generate the corrected log 932 of FIG. 9. In such an example, the report generator 250 may generate a report including the corrected log 932, a recommendation to perform a wellbore operation on the borehole 104 of FIG. 1 based on the report, etc. In response to generating the log, the example method 1100 of FIG. 11 concludes.

FIG. 12 is a flowchart representative of an example method 1200 that may be performed by the example measurement manager 100 of FIGS. 1-2 to generate a log associated with the example formation 106 of FIG. 1. The example method 1200 begins at block 1210, at which the example measurement manager 100 selects a time interval of interest for speed correction. For example, the collection engine 210 may select a time interval that correspond to number of turns from 100 to 500 of FIG. 3 to process.

At block 1220, the example measurement manager 100 determines if borehole features need to be enhanced. For example, the collection engine 210 may obtain the first and second logs 300, 304 from the logging tool 102 when the logging tool 102 is removed from the borehole 104 of FIG. 1 and determine if the example logs 300, 304 are already pre-processed or known to be in sufficiently good quality. If the borehole features do not need to be enhanced, the measurement manager 100 may proceed to block 1030 to determine parameters M and L for the coherence calculation 230 of FIG. 2 without pre-processing in the pre-processor 220 of FIG. 2. In the illustrated example of FIG. 12, a circle with index 2 indicates the block process may access to the database 260 in FIG. 2, from which input or output data and parameters may be stored or/and read-out. For example, the measurement manager 100 may obtain the parameters M and L from the database 260. If the borehole features need to be enhanced, the measurement manager 100 proceeds to block 1222.

At block 1222, the example measurement manager 100 inputs the example measurement information data 302, 306 to a pre-processing module 1222 to enhance borehole features (e.g., the pre-processor 220). For example, one borehole feature enhancement is to increase intensity or amplitude contrast specific to the borehole and formation by removing or minimizing artifacts or noise usually unrelated to the borehole and formation features, such as tool eccentering effect as illustrated as background gradation change 344 in FIG. 3, sinusoidal intensity offset 342 in FIG. 3, or cuttings and formation debris that may give sporadic and random intensity variation in one sensor or between the first and second sensors 116, 118. In some examples, the pre-processing module 1222 (e.g., pre-processing module 220) may utilize image processing techniques, such as denoising, edge enhancement, maximum or minimum or median filtering, etc. to enhance the borehole features. After the pre-processing module 1222 applies feature enhancement, an example module 1224 (e.g., block 1224) may generate a log in azimuth-scan-line domain for quality control, as illustrated in the example logs of 400 and 404 of FIG. 4, from which quality of enhancement can be visually and interactively controlled. The example borehole features in the example logs 300, 304 of FIG. 3, such as the natural fracture 312, the first and second formation layering 313, 316 are illustrated more clearly in corresponding features in enhanced logs 400, 404 of FIG. 4. In some examples, enhanced intensity may be quantitatively controlled by presenting a scan line data of two sensors before and after enhancement, for example, as illustrated as the example scan line curve before enhancement 307 of FIG. 3 and after enhancement 407 of FIG. 4.

At block 1230, the example semblance calculator 230 of the example measurement manager 100 starts parameter initialization by determining parameters M and L. J is an example scan line index of the measurement information of the first sensor 116. K is an example scan line index of the measurement information of the second sensor 118. The scan line indices J and K are integer numbers in the range from 1 to N of the module 1210. Example parameters M and L are processing parameters of the scan line number that are utilized by the example semblance calculator 230.

At block 1232, the example semblance calculator 230 prepares example data UD1 with index J for the first sensor 116 of FIG. 1. The data UD1(J) consists of scan lines within a range from J−L to J+L, including 2L+1 scan lines. Parameter L controls the number of scan lines that are to be input into a semblance calculation at one scan line. Group data may be useful when azimuthal scan line data is not fulfilled in case tool speed is too fast relative to tool rotation speed. The example semblance calculator 230 determines the initial scan line index of the second sensor 118 or K to J−M. Parameter M limits semblance calculation within J−M and J+M index in place of a full index from 1 to N to reduce the total computation time and/or reduce the computational burden on a processor.

At block 1234, the example semblance calculator 230 determines example data US2 at scan line K of scan lines from K−L to K+L for the second sensor 118.

At block 1236, the example semblance calculator 230 computes semblance factor, S for the data UD1 at scan line J of the first sensor 116 and the data UD2 at scan line K. In some examples, the semblance factor is an indicator of similarity of the data, UD1, UD2. For example, the semblance factor may be a Pearson correlation coefficient, a cross-correlation coefficient, a square-magnitude of coherence, or the minimum differences indicated by a summation of squared differences of the data UD1, UD2. Alternatively, the data UD1, UD2 may be transformed into spatial frequency domain using discrete cosine transform or wavelet transform, and their partial or the entire spectral data after the transformation can be used to determine semblance of the data UD1, UD2. Single or multiple methods can be combined to determine the maximum semblance, also including other mathematical algorithms to determine similarity of two data sets. In some examples, a part of the data UD1, UD2 may be weighted or rejected as outliers. For example, associated data for in a case of ultrasonic pulse-echo amplitude measurements, pulse-echo travel time data is recorded from the same signals and may be used to control quality of the amplitude data for semblance computation. The semblance calculation is repeated over 2M+1 scan lines of the enhanced measurement information of the second sensor 118 before proceeding to the next block.

At block 1238, the example semblance calculator 230 searches an example K-index, KX, that maximizes semblance factor, S(J,K). The index is stored in IDX data at index J. From two timestamps at indices J and KX, an example time delay, depicted as Δt 620 in FIG. 6, is computed and stored in DT(J) by the semblance calculator 230. This time delay computation is repeated for all scan line data of the first sensor 116, for the indices from 1 to N.

At block 1240, the example speed and depth calculator 240 computes average tool speed ATS using the sensor offset value ΔD and DT. The average speed is to be attributed to speed at the mid-point of J and K indices.

At block 1242, the speed and depth calculator 240 computes speed-corrected tool depth, integrating ATS(J) using the time increment. For example, the average tool speed in the block 1240 is integrated over time, including their timestamps, and stored in depth data of the first sensor 116, DEPC at index J. Depth of the second sensor 118 at index K is smaller or shallower than DEPC(K) by ΔD. If a value is not available in the DEPC data, data may be estimated by interpolating the available depth data.

At block 1244, the speed and depth calculator 240 adjusts DEPC(J) based on key node depths (start, end), correcting computational errors and delay. For example, the integrated depth DEPC is adjusted by the example speed and depth calculator 240 based on example key node depths d1 and d2, respectively initial and end depth of the first sensor 116. An example first depth data of speed-corrected depth DEPC(1) is identical to the first integrated depth offset by d1. The last available data of integrated depth must be equal to the depth d2-d1-ΔD. Scan line depths in the last ΔD depth interval may be estimated by linearly extrapolating tool speed over ΔD including their timestamps. Extrapolated end depth DEPC(N) must be equal to the theoretical end depth d2-d1-ΔD. In case the end depth differs from the theoretical value, DEPC may be linearly scaled by applying an example gain factor, (d2-d1-ΔD/(DEPC(N)-DEPC(1)).

At block 1250, the example report generator 250 bins scan line data of enhanced S1 and S2 data including adjusted/corrected speed depth. For example, the report generator 250 bins the measurement data of the first and second data to depths including the adjusted and speed-corrected depth ADEPC. If another time interval is to be selected, the process returns to block 1210. However, if there is no other time interval of interest, the process proceeds to block 1252.

At block 1252, the example report generator 250 generates log in azimuth-depth domain. For example, the report generator 250 may generate logs using the depth binned data at block 1250. The report generator 250 may bin other measurement information 360 referring the adjusted and speed-corrected depth ADEPC.

Figure 13:
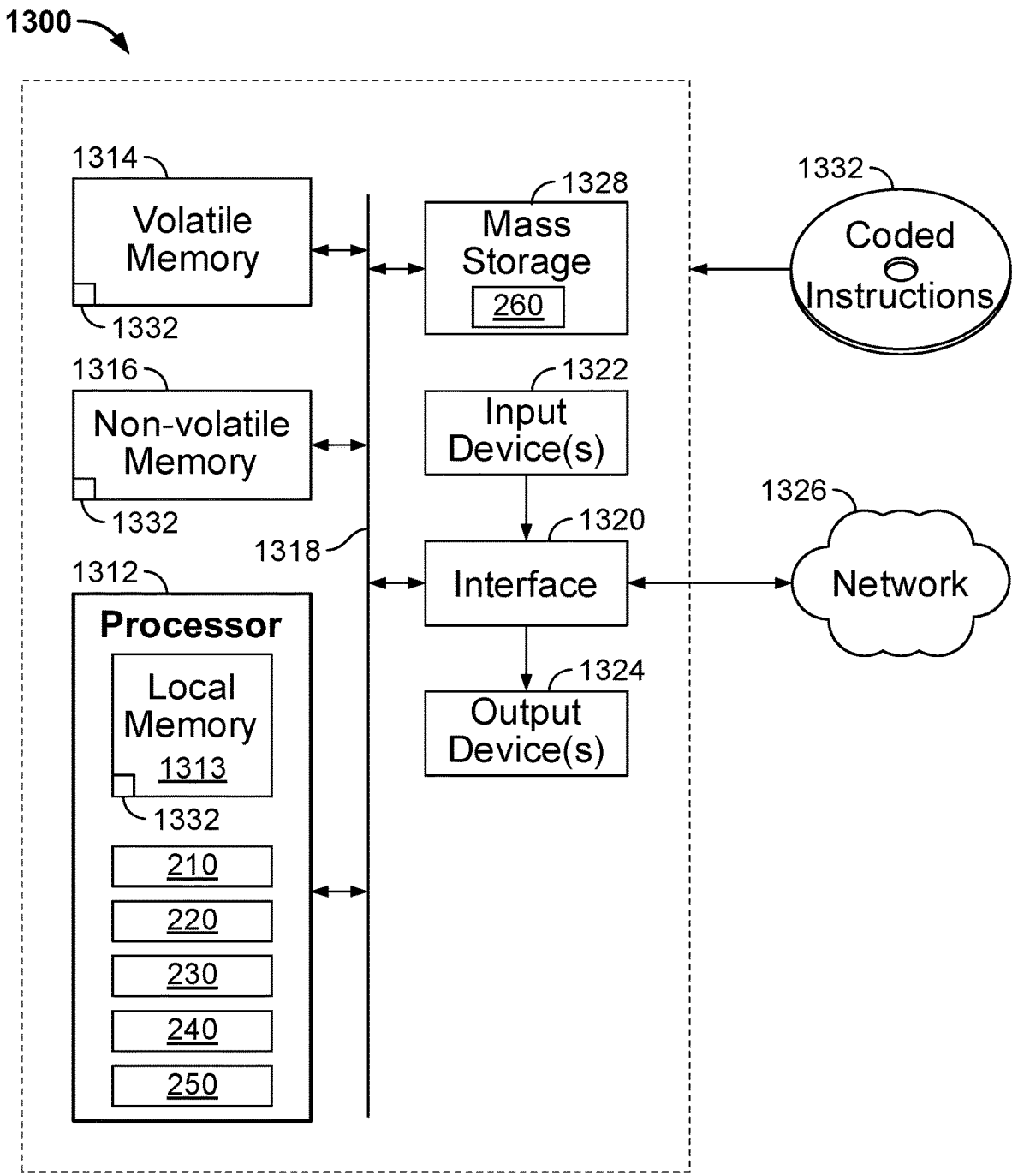
FIG. 13 is a block diagram of an example processing platform structured to execute the instructions of FIGS. 11 and/or 12 to implement the example measurement manager apparatus of FIGS. 1-2.

FIG. 13 is a block diagram of an example processor platform 1300 structured to execute the instructions of FIGS. 11 and 12 to implement the example measurement manager 100 of FIGS. 1-2. The processor platform 1300 can be, for example, a server, a personal computer, a workstation, a self-learning machine (e.g., a neural network), a mobile device (e.g., a cell phone, a smart phone, a tablet such as an iPad™), or any other type of computing device.

The processor platform 1300 of the illustrated example includes a processor 1312. The processor 1312 of the illustrated example is hardware. For example, the processor 1312 can be implemented by one or more integrated circuits, logic circuits, microprocessors, GPUs, DSPs, or controllers from any desired family or manufacturer. The hardware processor may be a semiconductor based (e.g., silicon based) device. In this example, the processor 1312 implements the example collection engine 210, the example pre-processor 220, the example semblance calculator 230, the example speed and depth calculator 240, and the example report generator 250 of FIG. 2.

The processor 1312 of the illustrated example includes a local memory 1313 (e.g., a cache). The processor 1312 of the illustrated example is in communication with a main memory including a volatile memory 1314 and a non-volatile memory 1316 via a bus 1318. The volatile memory 1314 may be implemented by Synchronous Dynamic Random Access Memory (SDRAM), Dynamic Random Access Memory (DRAM), RAMBUS® Dynamic Random Access Memory (RDRAM®), and/or any other type of random access memory device. The non-volatile memory 1316 may be implemented by flash memory and/or any other desired type of memory device. Access to the main memory 1314, 1316 is controlled by a memory controller.

The processor platform 1300 of the illustrated example also includes an interface circuit 1320. The interface circuit 1320 may be implemented by any type of interface standard, such as an Ethernet interface, a universal serial bus (USB), a Bluetooth® interface, a near field communication (NFC) interface, and/or a PCI express interface.

In the illustrated example, one or more input devices 1322 are connected to the interface circuit 1320. The input device(s) 1322 permit(s) a user to enter data and/or commands into the processor 1312. The input device(s) can be implemented by, for example, an audio sensor, a microphone, a camera (still or video), a keyboard, a button, a mouse, a touchscreen, a track-pad, a trackball, an isopoint device, and/or a voice recognition system.

One or more output devices 1324 are also connected to the interface circuit 1320 of the illustrated example. The output devices 1324 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer, and/or speaker. The interface circuit 1320 of the illustrated example, thus, typically includes a graphics driver card, a graphics driver chip, and/or a graphics driver processor.

The interface circuit 1320 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1326. The communication can be via, for example, an Ethernet connection, a digital subscriber line (DSL) connection, a telephone line connection, a coaxial cable system, a satellite system, a line-of-site wireless system, a cellular telephone system, etc. The network 1326 implements the example network 126 of FIGS. 1-2.

The processor platform 1300 of the illustrated example also includes one or more mass storage devices 1328 for storing software and/or data. Examples of such mass storage devices 1328 include floppy disk drives, hard drive disks, compact disk drives, Blu-ray disk drives, redundant array of independent disks (RAID) systems, and digital versatile disk (DVD) drives. The one or more mass storage devices 1328 implements the example database 260 of FIG. 2.

The machine executable instructions 1332 of FIGS. 11 and 12 may be stored in the mass storage device 1328, in the volatile memory 1314, in the non-volatile memory 1316, and/or on a removable non-transitory computer readable storage medium such as a CD or DVD.

From the foregoing, it will be appreciated that example methods, apparatus, and articles of manufacture have been disclosed that measure formation features. Examples described herein adjust and/or otherwise improve measurement information associated with formation features by identifying a depth discrepancy event. Examples described herein reduce storage resources used to process measurement information as a corrected log can replace two or more logs generated by two or more sensors. Examples described herein improve an availability of computing resources, which can be reallocated to other computing tasks, by calculating a corrected log using less intensive data processing techniques than in prior examples. Examples described herein can be applied to two sets of measurements measured by two different physics-based methods if both sets of measurements are sensitive to substantially similar borehole or formation features. Examples described herein can be applied in examples when running out of hole.

Although certain example methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

What is claimed is:

1. A method for generating a corrected wellbore log, the method comprising:

receiving first and second logs made with corresponding first and second axially spaced ultrasonic measurement sensors on a logging tool, the first and second logs made while rotating and translating the logging tool in a wellbore such that each of the first and second logs includes a two-dimensional image of a sensor measurement versus a number of tool rotations and wellbore azimuth, the two-dimensional image including a plurality of azimuthal scan lines;

selecting a depth of interest in the first and second logs;

identifying (i) a first feature measured at a first time at the selected depth in the first log, (ii) a second feature measured at a second time at the selected depth in the second log;

and (iii) a third feature measured at a third time at a subsequent depth in one of the first and second logs, wherein the first feature and the second feature are the same feature;

processing a difference between the first feature in the first log and the second feature in the second log to compute a correction factor;

applying the correction factor to the third feature to correct a depth discrepancy of the third feature;

repeating the selecting, the identifying, the processing, and the applying for a plurality of selected other depths and a plurality of other features in the first and second logs to generate the corrected wellbore log;

and performing at least one of a cementing operation, a coiled-tubing operation, a hydraulic fracturing operation, or setting a packer using the corrected wellbore log.

2. The method of claim 1, wherein the identifying and the processing comprises in combination:

processing the first and second logs to enhance formation features and generate corresponding first and second enhanced logs by first removing a sinusoidal background from the azimuthal scan lines and then scaling the background removed scan lines to increase intensity variation of the formation features;

identifying the first feature measured at the first time at the selected depth in the first enhanced log, the second feature measured at the second time at the selected depth in the second enhanced log, and the third feature measured at the third time at the subsequent depth in one of the first and second enhanced logs; and processing the difference between the first feature in the first enhanced log and the second feature in the second enhanced log to compute the correction factor.

3. The method of claim 1, wherein the applying comprises:

computing an average tool speed from a difference between the second time and the first time and an axial distance between the first and second ultrasonic measurement sensors;

integrating the average tool speed over time to compute an integrated depth; and adjusting the integrated depth based on the selected depth and the subsequent depth.

4. The method of claim 1, wherein the processing the difference comprises correlating the first feature in the first log with the second feature in the second log to compute the correction factor.

5. The method of claim 1, wherein the first and second axially spaced ultrasonic measurement sensors comprise first and second pulse-echo ultrasonic sensors.

6. A method for logging a wellbore, the method comprising:

receiving first and second logs S1(J) and S2(K) made with corresponding first and second axially spaced ultrasonic measurement sensors on a logging tool over a selected depth interval, the first and second logs made while rotating and translating the logging tool in the wellbore such that each of the first and second logs includes a two-dimensional image of an ultrasonic sensor measurement versus wellbore azimuth and a plurality of corresponding scan line index values J, K;

incrementally processing the first and second logs S1(J) and S2(K) to compute a set of correlation factors S(J,K);

selecting a scan line index value K that maximizes S(J,K) for each scan line index value J to obtain a set of pairs of index values J,K;

processing the set of pairs of index values J,K and first and second reference depths to compute adjusted depths at each scan line index value J;

correcting the first and second logs S1(J) and S2(K) with the adjusted depths; and performing at least one of a cementing operation, a coiled-tubing operation, a hydraulic fracturing operation, or setting a packer one or more wellbore operations using the corrected first and second logs.

7. The method of claim 6, wherein the processing comprises:

processing the set of pairs of index values J,K to compute a tool speed at each scan line index value J;

integrating the tool speed at each scan line index value J to compute a speed corrected tool depth at each scan line index value J; and adjusting the speed corrected tool depth at each scan line index value J with at least one of the first and second reference depths to obtain adjusted depths at each scan line index value J.

8. The method of claim 7, wherein the processing the set of pairs of index values J,K to compute the tool speed at each scan line index value J comprises:

processing the set of pairs of index values J,K to obtain a time delay at each scan line index value J; and processing the time delay at each scan line index value J and an axial distance between the first and second ultrasonic sensors to compute the tool speed at each scan line index value J.

9. The method of claim 7, wherein the adjusting comprises:

computing a difference between the second reference depth and a corresponding one of the speed corrected tool depths;

processing the difference to compute a gain; and processing the gain to linearly scale the speed corrected tool depth at each scan line index value J to compute the adjusted depths at each scan line index value J.

10. The method of claim 6, wherein the correcting comprises assigning the adjusted depths at each scan line index value J to the first and second logs S1(J) and S2(K).

11. The method of claim 6, wherein the selected depth interval is a depth interval from the first reference depth to the second reference depth.

12. The method of claim 6, wherein the incrementally processing comprises:

processing the first and second logs S1(J) and S2(K) to enhance formation features and generate corresponding first and second enhanced logs UD1(J) and UD2(K), the processing including (i) removing a sinusoidal background and (ii) scaling to increase intensity variation of the formation features; and incrementally processing the first and second enhanced logs UD1(J) and UD2(K) to compute the set of correlation factors S(J,K).

13. The method of claim 6, wherein the correlation factors S(J,K) are computed using a semblance algorithm.

14. The method of claim 6, further comprising:

repeating the receiving, the incrementally processing, the selecting, the processing, and the correcting for another depth interval in the wellbore.

15. A system for logging a wellbore, the system comprising:

first and second axially spaced ultrasonic sensors deployed on a logging tool body, the first and second axially spaced ultrasonic sensors configured to make ultrasonic logging measurements while the tool body is rotated and translated in the wellbore;

a processor configured to:

receive first and second logs S1(J) and S2(K) made with the corresponding first and second ultrasonic sensors over a selected depth interval, each of the first and second logs including a two-dimensional image of an ultrasonic sensor measurement versus wellbore azimuth and a plurality of corresponding scan line index values J, K;

incrementally process the first and second logs S1(J) and S2(K) to compute a set of correlation factors S(J,K);

select a scan line index value K that maximizes S(J,K) for each scan line index value J to obtain a set of pairs of index values J,K;

process the set of pairs of index values J,K and first and second reference depths to compute adjusted depths at each scan line index value J;

correct the first and second logs S1(J) and S2(K) with the adjusted depths; and perform at least one of a cementing operation, a coiled-tubing operation, a hydraulic fracturing operation, or setting a packer using the corrected first and second logs.

16. The system of claim 15, wherein the first and second axially spaced ultrasonic sensors are axially spaced apart by a distance from 0.2 to 10 inches on the logging tool body.

17. The system of claim 15, wherein the first and second axially spaced ultrasonic sensors comprise first and second pulse-echo ultrasonic sensors.

18. The system of claim 15, wherein the processor is configured to:

process the set of pairs of index values J,K to compute a tool speed at each scan line index value J;

integrate the tool speed at each scan line index value J to compute a speed corrected tool depth at each scan line index value J; and adjust the speed corrected tool depth at each scan line index value J with the first and second reference depths to obtain adjusted depths at each scan line index value J.

19. The system of claim 18, wherein the processor is configured to:

process the set of pairs of index values J,K to obtain a time delay at each scan line index value J; and process the time delay at each scan line index value J and an axial distance between the first and second ultrasonic sensors to compute the tool speed at each scan line index value J.

20. The system of claim 15, wherein correcting the first and second logs comprises assigning the adjusted depths at each scan line index value J to the first and second logs S1(J) and S2(K).

* * * * *